United States Patent [19]

Hickman et al.

[11] 4,157,174

[45] Jun. 5, 1979

[54] COLLAPSIBLE WORKBENCHES

[75] Inventors: Ronald P. Hickman; Brian A. Luff, both of Trinity, Jersey, Channel Islands

[73] Assignee: Inventec International Limited, Channel Islands

[21] Appl. No.: 793,549

[22] Filed: May 4, 1977

[30] Foreign Application Priority Data

| | | | |
|---|---|---|---|
| May 5, 1976 | [GB] | United Kingdom | 18293/76 |
| Oct. 21, 1976 | [GB] | United Kingdom | 43740/76 |
| Mar. 11, 1977 | [GB] | United Kingdom | 10425/77 |

[51] Int. Cl.[2] ..... B25B 1/10

[52] U.S. Cl. ..... 269/139; 269/244; 269/321 CF

[58] Field of Search ..... 269/139, 244, 321 CF; 144/286 R; 108/144, 145, 133, 128, 127, 115, 119, 122, 123, 111; 182/155; 248/166, 170, 436, 439, 188.6

[56] References Cited

U.S. PATENT DOCUMENTS

| | | | |
|---|---|---|---|
| 1,976,422 | 10/1934 | Van Seyle et al. | 108/123 |
| 2,423,529 | 7/1947 | Taylor | 248/439 |
| 3,001,559 | 9/1961 | Szopo | 144/286 R |
| 3,177,974 | 4/1965 | Martin et al. | 182/155 |
| 3,817,349 | 6/1974 | Barthel | 248/166 X |
| 4,034,684 | 7/1977 | Carson et al. | 108/127 |

FOREIGN PATENT DOCUMENTS

| | | | |
|---|---|---|---|
| 543179 | 5/1956 | Italy | 108/123 |

*Primary Examiner*—Robert C. Watson
*Attorney, Agent, or Firm*—Brumbaugh, Graves, Donohue & Raymond

[57] ABSTRACT

In the illustrative embodiments of the invention disclosed, a portable, dual-height workbench has front and rear elongate vice members forming the work surface of the bench and a collapsible supporting structure which allows selective positioning of the work surface at either workbench height or sawhorse height above the floor. The collapsible supporting structure includes front and rear, flat leg frames pivoted at the upper ends thereof to the top structure of the bench and closed at the lower ends thereof by horizontal cross pieces. The leg frames pivot relative to the bench top structure between an erected position, in which the frames extend downward from the bench top structure in front-to-rear splayed relation, and a collapsed position, in which the leg frames extend generally parallel to the working surface of the bench. A pair of retractable leg extensions is mounted to the horizontal cross piece of each leg frame for pivotal movement in the plane of the leg frame between an extended position, in which the leg extensions splay outward and downward from the cross pieces, and a retracted position, in which the leg extensions lie behind the respective horizontal cross pieces. When extended, the leg extensions support the work surface at workbench height and, when retracted, the work surface is supported by the leg frames at sawhorse height.

45 Claims, 20 Drawing Figures

COLLAPSIBLE WORKBENCHES

BACKGROUND OF THE INVENTION

This invention relates to loadbearing supports and in particular to workunits or workbenches.

A recent development in collapsible and portable workbenches has excited the enthusiastic interest of professional and home craftsmen throughout the world and has earned unprecedented acceptance because of its great and manifold utility. This development is represented in several patents including U.S. Pat. Nos. 3,615,087 and 3,841,619 and also in British Pat. No. 1,422,521. A related development is illustrated in German Offenlegungsschrift 2,540,000 dated Apr. 1, 1976.

Without detracting from the success of previous designs such as these shown in these specifications, we have found that, by careful redesign, certain aspects of the bench can be improved and at the same time certain economies made in manufacture.

According to one aspect of the present invention a load bearing support comprises a top structure, and a collapsible supporting structure which includes a pair of generally flat frames pivotally connected to the top structure for swinging movement between a collapsed position in which at least portions of the frames and the top structure lie close together, and an erected position in which the frames support the top structure on four feet above the ground. The supporting structure also includes four retractable extensions, two of which are mounted on one of the frames and the other two are mounted on the other of the frames. The extensions can be moved between an extended position in which feet of the extensions contact the ground, and a retracted position in which, whether the frames are collapsed or erected, each pair of extensions lies generally within the frame to which the pair of extensions are connected. The top structure is supported at a first height above the ground when the frames are erected and the extensions are extended, and is supported at a second, lesser, height above the ground, when the frames are erected and the extensions are retracted. Collapsing and erecting of the frames is possible whether the extensions are retracted or extended.

Each retractable extension, when in its extended position, preferably lies substantially in the same plane as the frame on which it is mounted.

When the retractable extensions are in their extended positions, their ground-engaging feet may be spaced apart in the direction parallel to the axes of swinging of the frames by a distance greater than the spacing in the same direction of the feet on the frames which engage the ground when the extensions are in their retracted positions. Each retractable extension may comprise a leg which is pivotable between the retracted position, in which it lies generally parallel to the axes of swinging of the frames, with its ground-engaging foot inboard of its other end, and the extended position, in which it extends obliquely outwards and downwards from the frame on which it is mounted. Preferably each retractable extension leg is provided with a tension toggle spring acting to hold it in whichever of its retracted and extended positions it has been placed.

Each frame may comprises a pair of legs connected, adjacent their ends remote from the top structure, by a horizontal bar, and the retractable extensions may be mounted on the horizontal bar of each frame. Each horizontal bar may comprise a channel whose opening faces downwards when the support is in its erected position, and the retractable extension legs are of such a cross-section that they can be received substantially behind at least one of the limbs of the channel, and are pivotally connected to the channel at their ends remote from their ground-engaging feet. When the retractable extension legs are in their retracted positions, their ground-engaging ends overlap. For simplicity of assembly and disassembly, the horizontal bars may be readily detachable from the legs of its frame.

According to another aspect of the invention a load bearing support comprises a top structure, and a collapsible supporting structure which includes a first generally flat frame and a second generally flat frame, each pivotally connected to the top structure for swinging movement about first and second pivot axes, respectively. The frames can be folded to a collapsed position in which the first frame lies on the same side of the second frame as does the top structure, and the frames and the top structure lie close together. The frames can also be unfolded to an erected position in which the frames support the top structure above the ground, with the frames diverging from one another in the downward direction. The supporting structure also includes at least one link whose ends are connected to the first and second frames for pivoting relative thereto about third and fourth pivot axes, respectively. When the support is in its erected position, the third and fourth axes lie at a lower level than either of the first and second pivot axes, and the third pivot axis lies at a level which is sufficiently below the level of the fourth pivot axis that the sum of the distances between the first and second pivot axes and between the first and third pivot axes is substantially equal to the sum of the distances between the second and fourth pivot axes and between the third and fourth pivot axes. This arrangement enables both the first and fourth pivot axes to lie close to the plane joining the second and third pivot axes in the collapsible position of the support. When the support is in its erected position, the second pivot axis lies at a level which is sufficiently lower than the level of the first pivot axis that, assuming that the attitude of the top structure is not changed from its erected position, the second frame can lie substantially horizontal in the collapsed position of the support. The first-mentioned sum of distances may be slightly greater than the second-mentioned sum of distances to enable the frames to lie substantially parallel to one another in the collapsed position of the support.

According to a specific construction at least the second frame includes a pair of legs, and the associated end of each link lies adjacent one of the legs, on the side of that leg closest to the other leg of the pair. The legs of the second frame may be connected, at their ends remote from the second pivot axis, by a horizontal bar. Each link may deviate from the straight line joining the third and fourth pivot axes, at least over the part of its length which lies adjacent the horizontal bar in the collapsed position of the support. The deviation is an upward deviation when seen in the erected position of the support.

Preferably the supporting structure also includes means for locking the support in its erected position. This locking means may comprise a folding linkage at each end of the supporting structure, comprising two parts connected by a pivot. The ends of each linkage are pivotally connected, respectively, to the second frame and to the top structure, and the axes of the pivotal connections at the ends of each linkage coincide with the first and fourth pivot axes.

Preferably, as the support is moved from its collapsed to its erected position, each folding linkage moves through a position in which its three pivots are co-linear, and shortly afterwards reaches a position in which further relative pivoting of the two parts of the linkage is prevented. Each folding linkage may be fitted with an overcenter action spring acting to hold the linkage in its erected position.

With the support in its erected positions, the frames preferably diverge in the downward direction to place their feet outside the worktop plan.

For convenience of manufacture, when the support is erected, the first and second frames lie at equal but opposite angles to the vertical. A possible alternative is for the frames to lie at different angles from the vertical, in particular so that the user can easily stand on a horizontal bar on the frame having the greater inclination either for sawing a workpiece, or for climbing on to the top structure. Also the user can place his foot on the horizontal bar for stabilizing the bench at either height.

The top structure may afford a working surface which lies horizontal when the support is erected, and lies generally parallel to the frames when the support is collapsed, whereby the support forms a workbench; and preferably the working surface is formed by a pair of elongate vise beams, one of which is movable relative to the other in directions parallel to the plane of the working surface and generally transverse to the length of the vise beams, to clamp a workpiece between adjacent edges of the vise beams. The movements of the one vise beam are produced by operation of one or both of a pair of independently operable clamping devices spaced along the length of the vice beams, whereby the gap between the vice beams may be made to taper along the length of the vice beams. The one vice beam is restrained against rocking about axes parallel to its length in response to the reaction force exerted by a workpiece on the one vise beam when the workpiece is gripped by the vise beams. Moreover, the top structure may include a pair of elongate supports which extend below and transversely to the length of the vise beams, one near each of the vise beams, and on which the vise beams are mounted. The first and second frames are pivoted to these elongate supports. In order to be able to clamp downwardly extending workpieces such as a door, the vise beams preferably project at their ends beyond the elongated supports for the vise beams.

According to yet another aspect of the present invention a workunit comprises a top structure having an upwardly facing supporting surface. A supporting structure is connected to the top structure and includes front and rear generally flat frames pivoted at their upper ends by front and rear pivotal connections to the top structure for movement between erected and collapsed positions. The front and rear pivotal connections are disposed adjacent the front and rear of the top structure respectively, and the frames, as viewed in side elevation when erected, are downwardly and outwardly splayed and rest on pads, which in the erected position can engage the floor at points forward and rearward respectively of a plan projection of the top structure. The frames, when folding from the erected position to the collapsed position, each move in the same rotary direction with respect to the top structure, with one frame leading the other, trailing, frame during such rotation. The frames are interconnected by rigid cross-ties, one at each end, which are pivoted to the frames by further pivotal connections, of which the pivotal connection to the leading frame is substantially lower on the frame than the pivotal connection to the trailing frame. During collapsing, the trailing frame approaches the leading frame and, in the collapsed position, at least part of the trailing frame lies close to the leading frame.

According to a further aspect of the present invention a combined workbench and sawhorse includes a top structure, a pair of front legs and a pair of rear legs for supporting the top structure at sawhorse height. Each pair of legs is interconnected adjacent its lower end by a horizontally extending strut. A pair of front lower legs and a pair of rear struts, and rear lower legs are pivoted respectively to the front and have retracted positions and extended positions, in the latter of which they position the top structure at workbench height. Below its pivotal connection to the strut, each lower leg, in its extended position, has a portion which abuts a thrust surface positioned on the main leg or the strut.

Conveniently, each lower leg is pivoted to one of the struts closely inboard of the connection of the strut to the main leg. In one arrangement the thrust surface is positioned adjacent the lower end of the main leg. Alternatively, the thrust surface may be afforded by a strengthening member secured to the inboard face main leg. In order to assist in obtaining complete front to back stability there may be additional thrust faces secured to the main leg or strut which lie close to or in contact with front and rear faces of the lower leg when erected.

In one construction the thrust surface and the additional thrust faces for each lower leg are formed on a block connected to the inboard face of the adjacent main leg. Alternatively, the thrust surface and the additional thrust faces for each lower leg are formed on a single sheet metal pressing. In a further construction the strengthening member carried a conical peg which engages in a circular aperture in the outboard side face of the lower leg.

Each horizontally extending strut may be a downwardly opening U-shaped channel having a pair of depending limbs and a top interconnecting web. Each lower leg may be pivoted to one of the struts by a bolt extending through each of the limbs of the U-shaped channel. Preferably each lower leg has, in the extended position, an upper portion above the pivot. Front and rear faces of the upper portion lie close to or in contact with the inside faces of the limbs of the U-shaped channel, and the front limb of the U-shaped channel may have a horizontal stiffening bead. The web of the U-shaped channel may form an upwardly facing step on which, when the lower legs are in their extended positions, a user can stand at an elevated height above the floor with the worktop at sawhorse height with respect to the user. For this purpose portions of the said web may be raised or grooved to form non-slip, foot gripping surfaces.

Each lower leg may be provided with a spring which tends to maintain the lower leg in its extended position. Preferably a spring is included for each lower leg tending to maintain the lower leg in its raised position. Conveniently the springs are one and the same and may be arranged to be stressed to go overcenter in bistable fashion during passage between the retracted and extended positions and vice versa.

In order to maintain a stable construction each lower leg, in its extended position, preferably lies in a plane containing its adjacent main leg but extends laterally to the side of that leg whereby the floor contact area of the lower legs is greater than the floor contact area of the main legs, extending therebeyond both forward and rearward, and on both sides.

In a specific embodiment the lower legs of each pair overlap one another in their retracted position and one lies partially above the other. Conveniently either lower leg of a pair can be raised first. Each lower leg may have a stud projecting from it to facilitate its movement manually between the retracted and extended positions.

In an alternative construction the horizontally extending strut, in the form of a U-shaped channel has an end plate at each end connected between the front and rear limbs of the channel. The end plate may be a folded part of one limb of the U, and the thrust surface may be integral with the folded part.

An alternative embodiment, not of a dual-height nature, has its four main legs projecting downwardly beyond the horizontal struts or bars by an amount substantially equal to the differential between normal workbench and sawhorse heights. 'Workbench height' may be between 29" and 34" and 'sawhorse height' may be between 18" and 25".

Construction of the type described can be made much more cheaply and quickly and with less expensive production equipment than those described in the prior patents referred to above. They have the great merit of simplicity, lightness, and ease of erection and folding. Nevertheless, when erected, the top structure, frames and links provide a very rigid six sided box-like construction with each side of the box forming a rigid diaphragm capable of resisting shear loads.

The invention may be carried into practice in various ways, but one specific workbench embodying the invention, and a number of modifications thereof, will now be described by way of example, with reference to the accompanying drawings, of which:

DESCRIPTION OF THE PREFERRED EMBODIMENT

Figure 1:
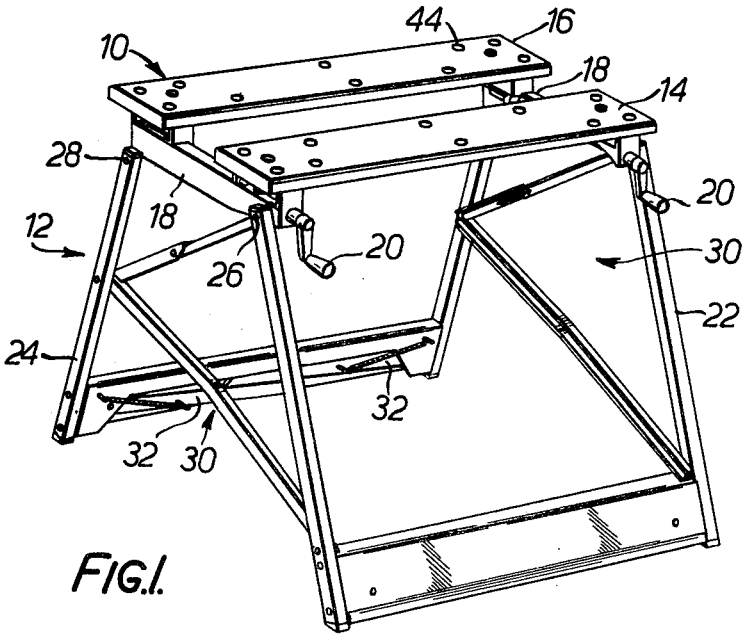
FIG. 1 is a perspective view of the workbench in a reduced height position, in which the bench may be used as a sawhorse.

Looking now at the drawings, wherein like reference numerals designate identical or corresponding parts, and particularly at FIG. 1 thereof, the workbench consists of a worktop 10, which is supported on a collapsible supporting structure 12. The worktop 10 consists essentially of two elongate wooden vise beams 14 and 16, which have their upper surfaces in the same plane and which together provide the working surface of the workbench, and two elongate supports 18, on which the vise beams 14 and 16 are mounted. The supports 18 extend for and aft, transversely to the length of the vise beams 14 and 16, one near each end of the vise beams. The vise beam 14 is rigidly connected to the supports 18, but the vise beam 16 can be shifted along the supports 18, towards and away from the vise beam 14, by rotation of two crank handles 20, so that a workpiece can be clamped between the vise beams 14 and 16.

The collapsible supporting structure 12 consists of a front frame 22 and a rear frame 24, which are connected by pivots 26 and 28, repectively, to the elongate supports 18. When the bench is in use, the frames 22 and 24 are in the positions shown in FIG. 1, in which they are splayed apart so that their lower, ground-engaging pads are spaced apart, forward and rearward of the plan projection of the top structure, so that the bench is sufficiently stable. The pivots 26 and 28 allow the frames 22 and 24 to be swung, relative to the worktop 10, from their erected position, as shown in FIG. 1, to a collapsed position, shown in FIG. 3, in which both frames lie approximately parallel to each other and to the working surface of the worktop.

At each side of the bench, a linkage 30, including a lower rigid strut and an upper folding strut, connects the two frames, so that movement of one frame from its erected position to its collapsed position, or vice versa, results in a corresponding movement of the other frame. The linkages 30 are so arranged that they lock into position when the bench is erected, so that the bench then becomes a rigid structure.

Each of the frames 22 and 24 includes, at its bottom end, two pivoted extension legs 32. These legs can be moved between a storage position, shown in FIG. 1, in which they lie above the ground contacting pads of the frames 22 and 24, and an operative extended position, shown in FIG. 2, in which they increase the effective height of the supporting structure 12. With the extension legs 32 in their storage position, the working surface of the bench is about 23" from the ground; this is a convenient height if the bench is to be used as a sawhorse. With the legs 32 in their operative extended position, the working surface of the bench is about 32" from the ground; this is a convenient height for workbench operations such as planing.

Figure 2:
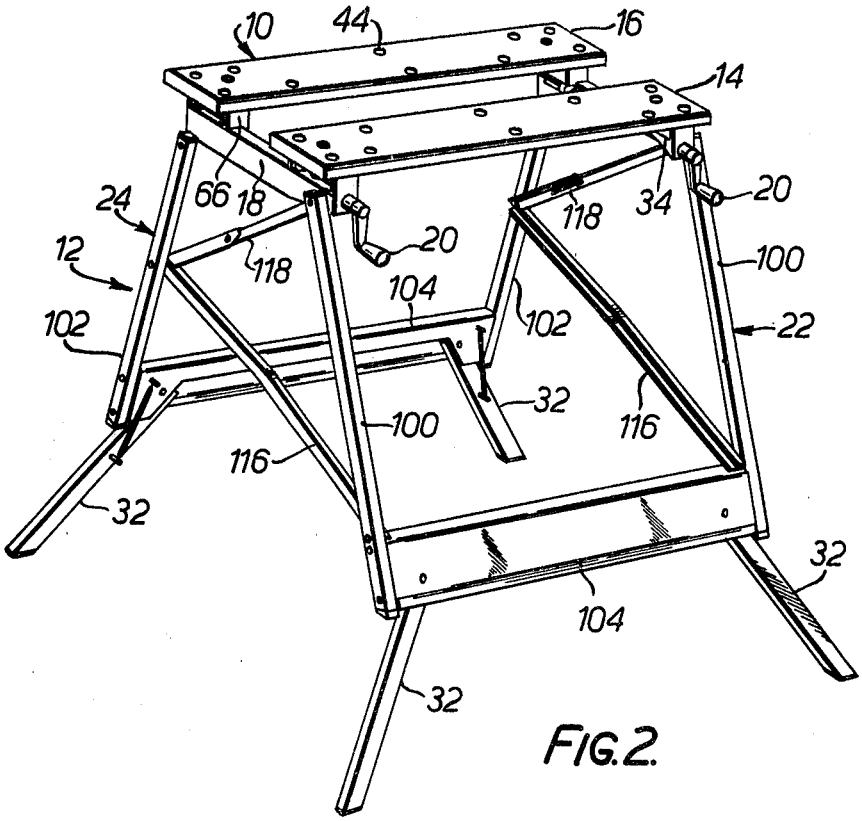
FIG. 2 is a view, similar to FIG. 1, but with the workbench in its full height position.
Figure 5:
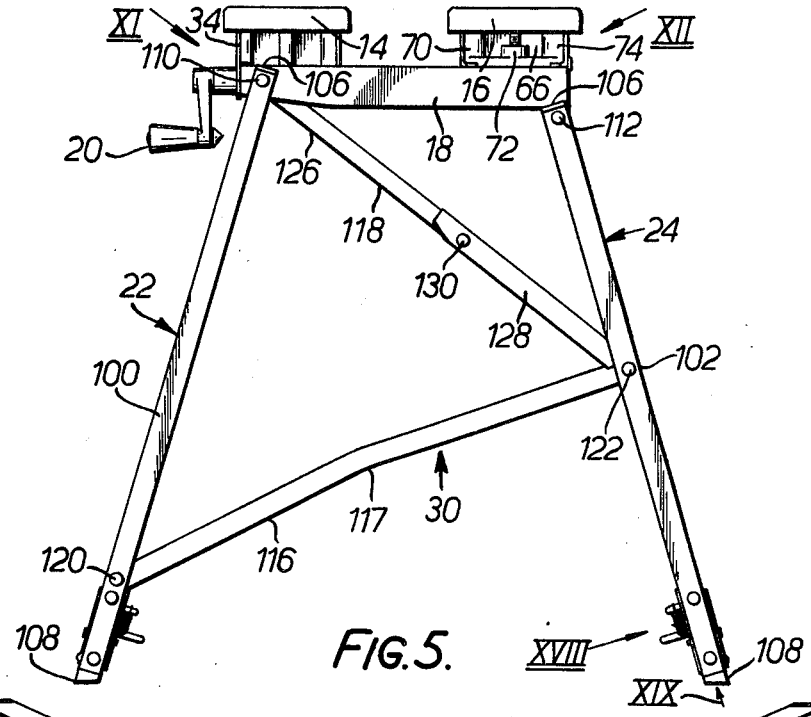
FIG. 5 is a side elevation showing the workbench in the position of FIG. 1.
Figure 7:
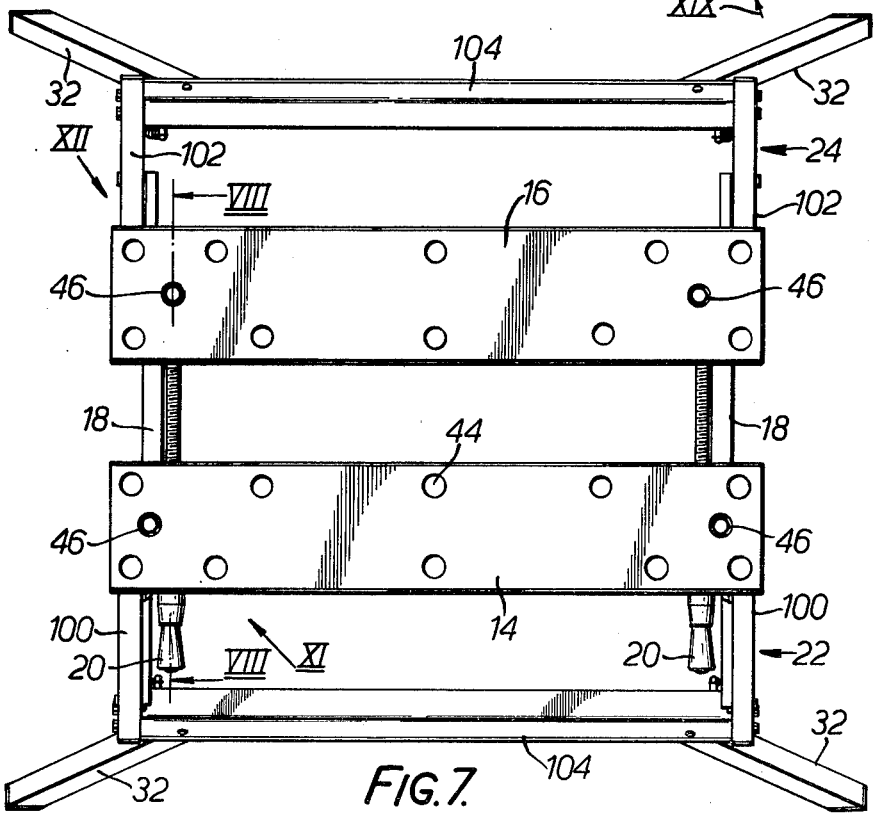
FIG. 7 is a plan view of the workbench in its full height position.
Figure 6:
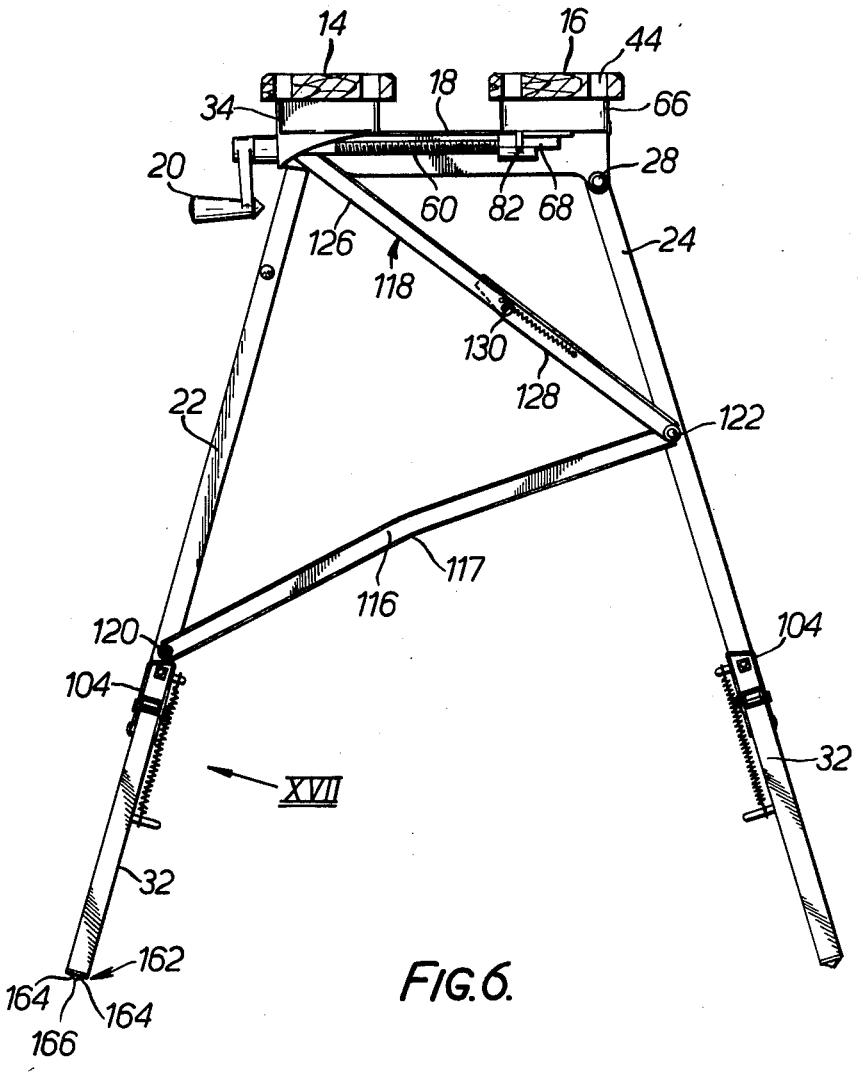
FIG. 6 is a view similar to FIG. 5, but showing the workbench in the position of FIG. 2, and taken in section on the median plane of the workbench.

It will be seen from FIG. 2 that the extension legs 32 are splayed, as seen in front or rear elevation, so that their use increases the lateral spacing between the points at which the supporting structure engages the ground. The front-to-back spacing of these points is also increased by use of the extension legs 32, because these legs lie in the same plane as the frames 22 and 24, which are themselves splayed to the front and rear. Thus, a change from the lower, sawhorse, height to the greater height is automatically accompanied by an increase in the spacings between the ground contact points both front to rear, and side to side, so that the stability of the bench is maintained; this is illustrated by FIGS. 5, 6 and 7.

The parts of the bench will now be described in greater detail.

Each of the vise beams 14 and 16 consists of a length of plywood, of rectangular cross-section, and is formed with a number of vertical bores 44, which can receive clamping abutments, in the manner disclosed in U.S. Patent application Ser. No. 642,742 filed Dec. 22, 1975. As shown in FIG. 7, each vise beam is also formed with a vertical counterbored hole 46 near each end, which receives a fixing bolt 48 and 50, shown in FIG. 8.

Figure 10:
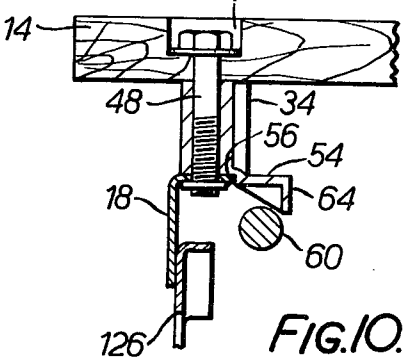
FIGS. 9 and 10 are partial sections on the lines IX—IX and X—X in FIG. 8.
Figure 9:
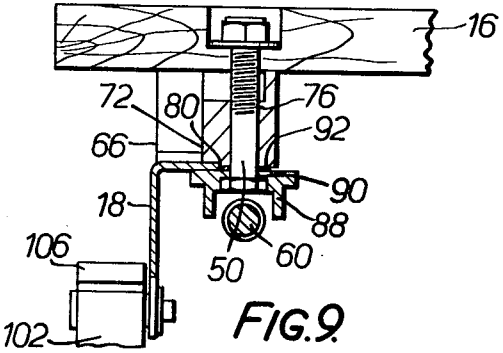

As shown most clearly in FIGS. 9 and 10, each of the elongate supports 18 is in the form of a sheet steel pressing, which is L-shaped in section. The longer leg of the L points downwards, while the shorter leg points horizontally inwards, towards the other of the elongate supports 18.

The vise beam 14 (hereafter referred to as the front or fixed vise beam) is rigidly connected to the supports 18, but this connection is not direct; two spacer blocks 34, one at each end of the vise beam 14, separate the vise beam from the supports 18. Each spacer block is an aluminium alloy diecasting, and its shape can be seen most clearly in FIGS. 10, 11 and 20. The main part of the spacer block is roughly I-shaped in plan, with the height of the I extending parallel to the length of the support 18, although it will be noticed that the four flanges are not all of the same width. On the outboard side of the stem 35 of the I, the spacer block has three vertically-extending bosses 36, 38 and 40. Of these bosses, the central boss 38 has a vertically-extending bore 42, which receives the fixing bolt 48; the head of the bolt, together with a washer, is received in the counterbore in the vise beam 14, while the threaded end of the bolt 48 passes through a hole in the horizontal leg of the support 18 and into a nut brazed or otherwise fixed on the underside of this leg, all as shown in FIG. 10. The other two bosses 36 and 40 are continued upwards, above the general level of the top surface of the spacer block 34, which abuts against the underside of the vise beam 14; the continuations of these bosses form two locating spigots 52, (FIG. 11), which are received in blind bores in the underside of the vise beam, so that the spacer block cannot move angularly relative to the vise beam 14 about the fixing bolt 48.

Each spacer block 34 has an integral continuation, in the form of a web 54 which extends generally horizontally, in the inboard direction (that is to say, towards the romote end of the vise beam 14) from the lower edge of the spacer block. As best illustrated in FIG. 10, this web 54 is stepped downwardly at 55 where it passes over the inboard edge of the support 18, and the resulting shoulder 56 in the underside of the web abuts against the inboard edge of the support 18, so that angular movement of the spacer block relative to the elongate support about the fixing bolt 48 is prevented. Thus, it will be seen that the vise beam 14, the spacer blocks 34, and the elongate supports 18 form a rigid assembly, even though only a single fixing bolt is used at each end.

Figure 11:
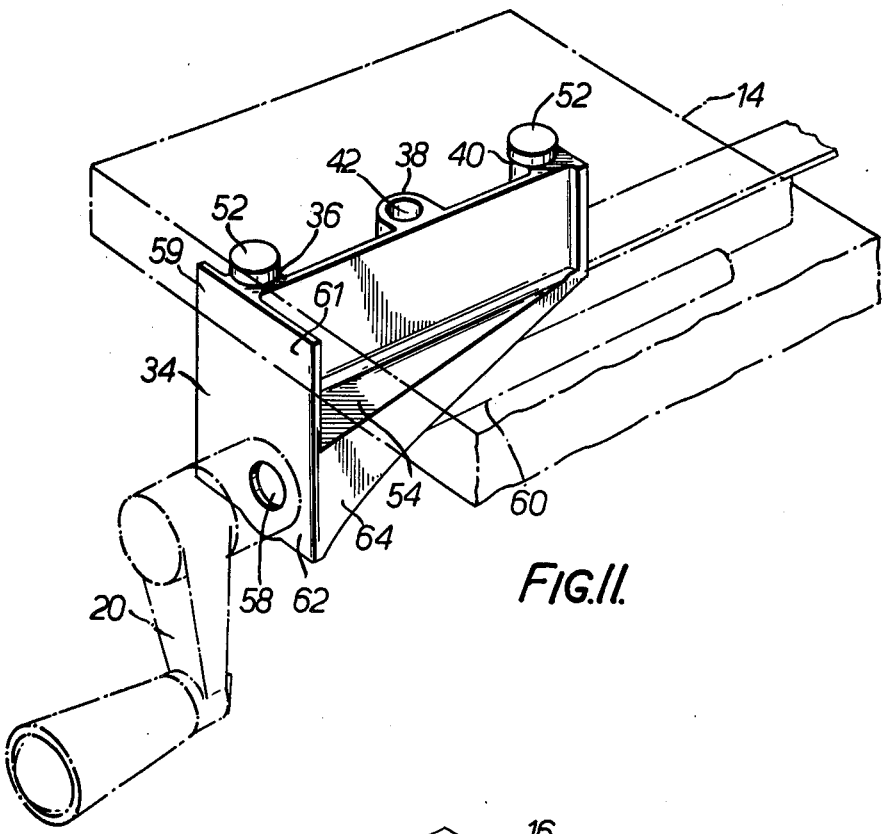
FIG. 11 is a perspective view of part of the workbench, taken in the direction of the arrow XI in FIGS. 5 and 7, with some parts of the workbench shown in phantom for better clarity of illustration.

Looking now at FIG. 11, the flanges 59 and 61 at the front end of the spacer block 34 are extended downwards beyond the under surface of the web 54, and the inboard flange 61 extends considerably further inboard than the stem 35 of the spacer block 34. The lowest part of this extended flange 61, as shown at 62, is provided with a bore 58, in which is journalled a vise screw 60, which can be operated by one of the handles 20. The flange 62 is braced to withstand forces applied to it by the vise screw 60 by means of the web 54, which merges into the rear surface of the flange 62. In addition, a further integral bracing web 64 extends vertically downwards from the inboard edge of the web 54, and merges into the flange 62 at its inboard vertical edge. The shape of these flanges can best be seen in FIG. 11.

Like the vise beam 14, the vise beam 16 (hereafter referred to as the rear or moving vise beam) is separated from the elongate supports 18 by a pair of spacer blocks 66; these spacer blocks can slide along the supports 18, but are rigidly connected to the vise beam 16. The fixing bolts 50 hold the vise beam 16 to the spacer blocks 66; each of these fixing bolts also serves to attach a vise nut 68 to the underside of the associated spacer block 66 for relative rotation therebetween through a horizontal angle. The vise screws 60 are threaded into the vise nuts 68, so that when a workpiece is clamped between the vise beams 14 and 16, by rotation of the handles 20, the clamping forces are carried by the following components: the vise beam 16, bolts 50, the spacer blocks 66, the vise nuts 68, the vise screws 60, the spacer blocks 34, the bolts 48, and the vise beam 14. It will be noted that the elongate supports 18 do not carry the main clamping loads.

Figure 8:
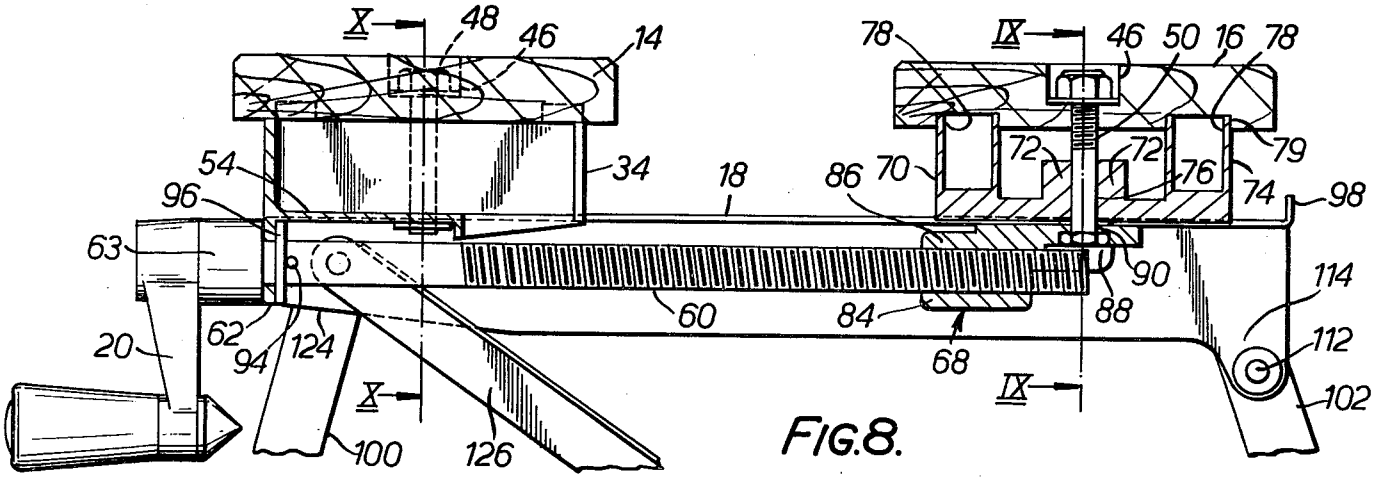
FIG. 8 is a partial section on the line VIII—VIII in FIG. 7.
Figure 12:
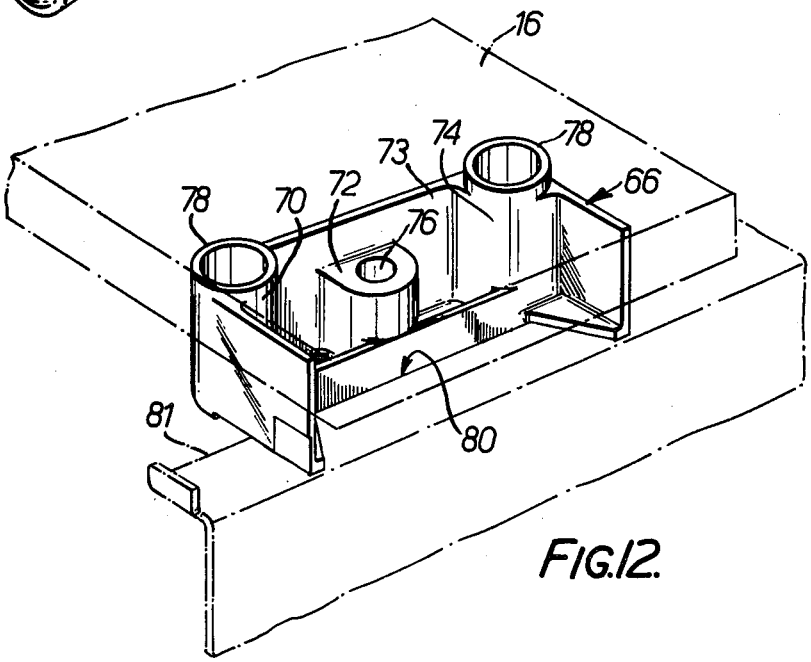
FIG. 12 is a perspective view of part of the workbench taken in the direction of the arrow XII in FIGS. 5 and 7, with some parts of the workbench shown in phantom.

As shown in FIGS. 8, 9, and 12 each of the spacer blocks 66 is a box-like aluminium alloy die-casting which includes three vertically-extending bosses 70, 72 and 74, of which the central boss 72 has a vertically-extending bore 76, within which the fixing bolt 50 is received. The bosses are interconnected by a vertical web 73, and the end bosses 70 and 74, like the bosses 36 and 40 of the front spacer blocks 34, are continued upwards to form locating spigots 78 which are received in blind bores 79 in the underside of the rear vise beam 16, so that the rear vise beam and the spacer blocks are fixed relative to one another.

Figure 13:
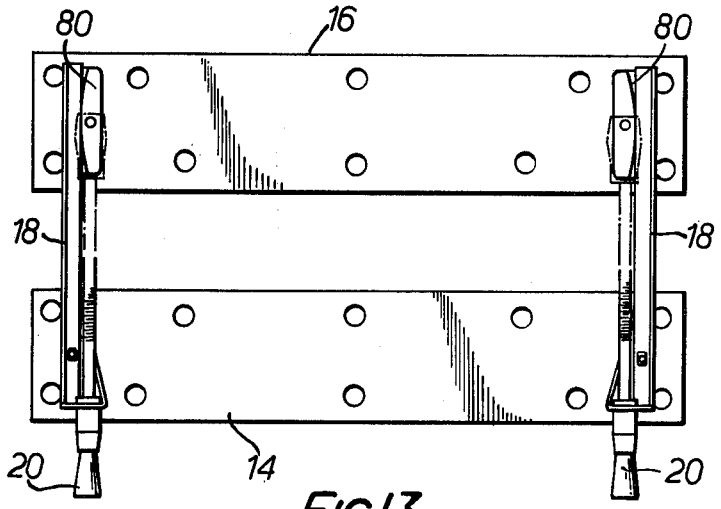
FIG. 13 is an underside view of the top structure of the workbench, with the beams which form the top surface of the workbench positioned parallel to one another.

The underside of each spacer block 66 is formed with a vertical step 80 (see FIG. 9), which engages againts the inboard edge 81 (see FIG. 12) of the horizontal leg of the associated elongate support 18, so that lateral movements of the rear vise beam are restricted by one or the other of the supports 18. In this embodiment as shown in FIGS. 12 and 13, the two vertical steps 80 are formed as arcs of the same circle, with its center at the middle of the vise beam 16. The diameter of this circle is almost equal to the spacing between the edges against which the steps 80 engage, so that the rear vise beam has only slight lateral freedom, whether it is lying parallel to or at an agle to the front vise beam 14. The guiding action of the steps 80 is best illustrated in FIGS. 9, 12, 13 and 14.

Any downward forces on the rear vise beam 16 are simply transmitted to the supports 18 by the engagement of the under surfaces of the spacer block 66 with the top surfaces of the supports 18, on which they slide.

Each of the vise nuts 68 is made of a lower part 84 and an upper part 86, both of which are aluminium alloy die-castings. The two parts have mating surfaces which lie in a horizontal plane through the axes of the vise screws 60, and are secured together by two screws 82 (see FIG. 6). The lower part 84 is a simple semi-cylindrical shell, with internal threads, whereas the upper part 86 has a generally channel-shaped extension 88 which lies to the rear of the main part of the nut. The two legs of this channel are present primarily to provide rigitity; they point downwards, so that the top surface of the extension 88 is flat. A bore 90 extends vertically through the extension 88, and receives the fixing bolt 50. The bore 90 opens at its bottom end into a hexagonal recess 91 formed in the inner surface of the channel. The recess 91 receives the head of the fixing bolt 50, which is also hexagonal, so that rotation of the bolt relative to the nut 68 is prevented by the engagement of the bolt head 90 in the recess 91.

The bolt 50 extends vertically up through the nut 68, the spacer block 66 and the vise beam 16, and emerges in a counterbore on the top of the vise beam 16, where it is fitted with a washer and a self-locking nut. The self-locking nut is tightened sufficiently to hold the parts together firmly, without play, but not so much that it prevents the vise nut 68 from pivoting relative to the spacer block 66; this pivoting movement is necessary for reasons which will become apparent. A fibre washer 92 (see FIG. 9) may be interposed between the spacer block 66 and the vise nut 68, to reduce the friction between these components when pivoting occurs.

The flat top of the extension 88 of the vise nut 68 provides one of the surfaces against which the fibre washer 92 bears and also acts to restrict upward movements of the rear vise beam 16, because part of this surface will engage the under surface of the horizontal leg of the support 18, as best seen in FIG. 9. In fact, to ensure that an adequate area of engagement occurs between the nut 68 and the support 18, the top of the extension 88 is widened in the area of the bore 90, so that the top surface of the extension is approximately coffin-shaped, as can be seen in dotted lines in FIGS. 13 and 14.

As mentioned above, each of the vise screws 60 is journalled in the bore 58 in one of the front spacer blocks 34. Movement of the vise screw 60 forward out of the bore 58 is prevented as shown in FIG. 8 by a rollpin 94 which passes through a cross bore in the vise screw, and which bears, through a steel asher 96, against the rear of the flange 62. Movement of the vise screw in the rearward direction is prevented by the crank handle 20, which is secured to the vise screw by a rollpin (not shown), and which bears against the front surface of the flange 62 through a cylindrical plastics spacer 63. The parts are so dimensioned that sufficient clearances are present to allow the axis of the screw 60 to swing slightly through a horizontal arc; the reason for this will become apparent shortly.

Figure 14:
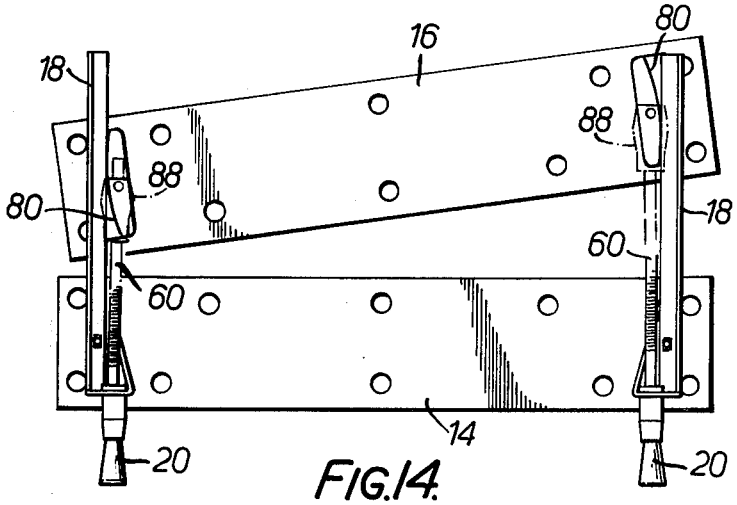
FIG. 14 is a view, similar to FIG. 13, but with the beams at an angle to one another.

When a workpiece is to be clamped, it is placed on the top bearing surface of the supports 18 between the vise beams 14 and 16, and the handles 20 are rotated to move the rear vise beam towards the front vise beam. Since in most cases the two handles will not be rotated in exact synchronism, and in many cases only one handle at a time will be rotated, it is necessary for the vise beam 16 to be able to adopt a position at an angle to the fixed vise beam 14. FIGS. 13 and 14 illustrate the vise beams 14 and 16 in parallel and angled relationships, respectively. As explained above, the steps 80 are of a shape which allows this angular movement, without affecting the amount of lateral play allowed to the rear vise beam 16. However, when the vise beam 16 moves to an angled position, each of the fixing bolts 50 swings slightly inboard, in the lateral direction, away from the adjacent support 18, about vertical axes through the bore 58. This means that the vise nuts 68 also move slightly further away from the supports 18, so that the vise screws 60 must adopt a slightly angled position. As explained above, this movement is possible because of the clearances which are built into the construction.

The vise nuts 68 also pivot relative to the rear vise beam 16, about the fixing bolts 50; as explained above, the bolts 50 are not tightened sufficiently to obstruct this movement.

The ability to position the vise beams at an angle to one another allows the crank handles 20 to be operated independently, and also means that tapered workpieces can be clamped.

Although, as explained above, the main clamping forces which draw the vise beams 14 and 16 together are borne by the vise screws 60 and not by the supports 18, the supports 18 are responsible for carrying the tilting moment which results from the vertical spacing between the vise screws 60 and the clamping surfaces of the vise beams. That part of the moment which is borne by each support 18 is transferred to that support in the form of a couple consisting of a downward force acting on the support 18 from the rear area of the associated spacer block 66, and an upward force acting on the support from the forward part of the flat top surface of the associated vise nut 68.

To prevent the rear vise beam 16 from being moved so far to the rear by rotation of the handles 20 that the vise screws 60 become disengagd from the vise nuts 68, each of the supports 18 has a turned-up tab 98 at its rear end. The spacer blocks 66 abut against these tabs when the free rear ends of the vise screws 60 are about flush with the rear ends of the vise nuts, so that there is still full engagement of the threads.

Looking back at FIGS. 1, 2 and 5, each of the front and rear frames 22 and 24 consists essentially of two legs 100 or 102 respectively, joined at their lower ends by a step bar 104. Each leg consists of a length of square steel tubing, fitted at its top end with a plastic plug 106 and at its bottom end with a plastic pad 108. The pads 108 have angled under surfaces, so that they form feet which rest squarely on the ground when the bench is in use at sawhorse height. The two frames lie at equal angles to the vertical when the bench is erected, so that the pads 108 used on the front and rear frames can be identical.

The upper end of each of the front legs 100 is pivoted to the outside of the vertical leg of the adjacent elongate support 18 by a pivot pin 110, which passes through holes in the two lateral walls of the leg 100 and in the leg of the support 18, with a washer between the inside wall of the leg 100 and the support 18. Although many forms of pivot pin could be used, in this specific example the pin has a plain round head and a plain cylindrical shank, and, after being passed through the holes in the components, is retained in place by a spring clip of the type known as a speednut, pushed on to the plain end of the shank. This type of pivot pin is used for most of the other pivotal connections in the supporting structure 12; only those connections which are of different construction will be specifically described hereafter.

The upper end of the rear legs 102 is connected, as shown in FIG. 8, by a pivot pin 112 to a downwardly-projecting ear 114, which is as an integral part of the vertical leg of the adjacent elongate support 18. Again, a washer is used between the leg 102 and the ear 114. It will be observed that the pivot pin 110 is at a higher level than the pivot pin 112. The difference in level between the pivot points of the front and rear legs means that, when the bench is collapsed by anti-clockwise rotation of the legs in FIG. 5, the front frame 22 lies closer to the plane of the working surface of the vise beams than does the rear frame 24. The difference in pivot pin level is desirable because, to achieve the most compact folded configuration wherein both the rear legs 102 and the front legs 100 lie on the outboard sides of the elongate supports 18, and in folded position lie closely adjacent and parallel to each other and the top, clearance must be provided otherwise the rear legs would engage the tops of the front legs before folding to a position exactly parallel to the working surface.

The linkages 30 which connect the two frames 22 and 24 each consist of a lower rigid strut 116 and an upper folding strut 118. The rigid struts 116 are responsible for synchronising the movement of the two frames between their erected and collapsed positions. The folding struts 118 lock into position when the bench has been erected.

Each rigid strut 116 is a sheet steel pressing of channel-shaped cross-section; the legs of the channel extend inboard, towards the opposite end of the workbench. The front and rear ends of each strut 116 are connected by pivot pins 120 and 122, respectively, to the front and rear legs 100 and 102 at that side of the workbench. Washers are fitted between the strut 116 and the legs 100 and 102. As can be clearly seen from FIG. 5, the front pivot pin 120 is at a considerably lower level than the rear pivot pin 122 when the bench is in its erected position. The reason for this, as explained below, can be seen from FIG. 3, which shows the bench in its collapsed position.

In the collapsed position, the front legs 100 have swung forward relative to the worktop 10, so that the pivot pins 110 and 122 lie very close to the line joining the pivot pins 112 and 120. The sum of the distance along the front leg 100 between the pivot pins 110 and 120 and the distance along the support 18 between the pivot pins 110 and 112 (the first sum) must therefore be almost exactly equal to the sum of the distance along the rear leg 102 between the pivot pins 112 and 122 and the length of the strut 116 between the pivot pins 120 and 122 (the second sum). The length of the strut 116 is greater than the length of the support 18 in order to achieve the splay of the legs 100 and 102, and this dictates the greater distance between the pins 110 and 120, as compared with the distance between the pins 112 and 122.

However, if the two sums mentioned above were exactly equal, the quadrilateral formed by the pivot pins 110, 112, 122 and 120 would be exactly symmetrical about the line joining the pins 112 and 120, and the front and rear legs would not be lying parallel to one another. For this reason, the first sum mentioned above is made very slightly greater than the second-mentioned sum, by an amount which upsets the symmetry of the quadrilateral just enough to bring the front and rear legs into exact parallelism with one another in the collapsed position of the workbench.

Figure 3:
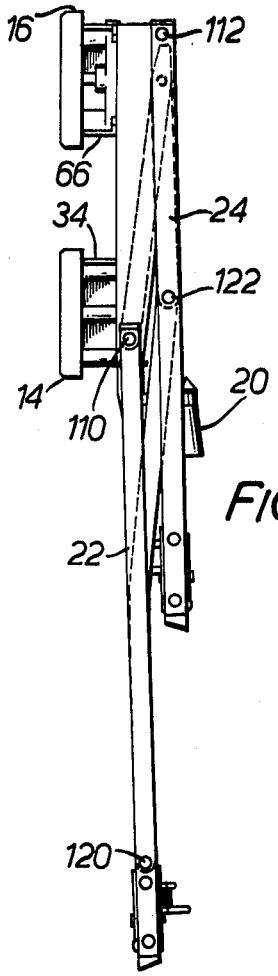
FIG. 3 is a side elevation of the workbench when collapsed for storage.
Figure 4:
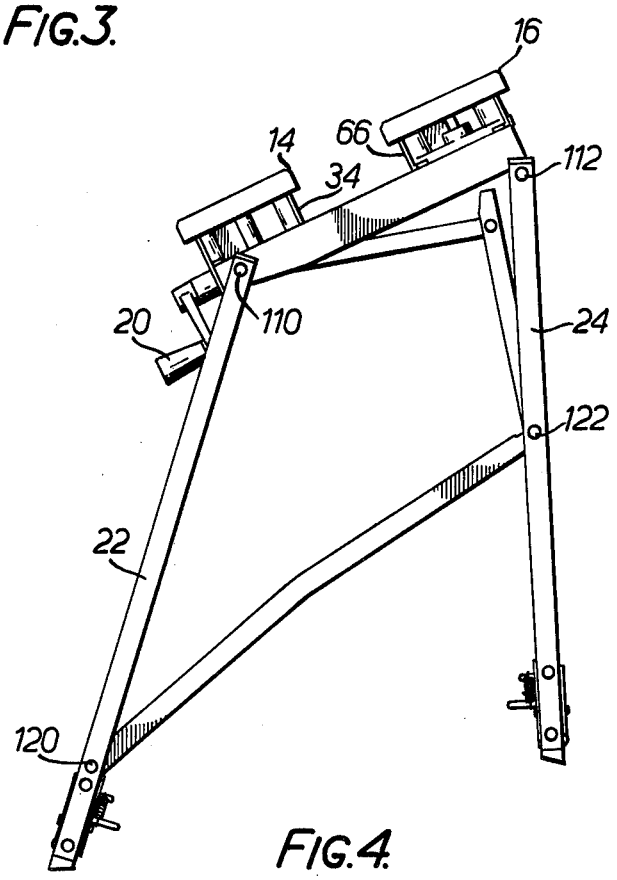
FIG. 4 is a side elevation showing the workbench in the process of being erected.

It will be seen from FIGS. 4 and 5 that the rigid struts 116 have a slight bend 117 of about 8° the middle of their length. The reason of this bend can be seen from FIG. 3: if the strut were made exactly straight, it would foul the forward (inside) face of the step bar 104 of the rear frame 24. It will also be seen from FIG. 8 that that vertical leg of each elongate support 18 has the front part of its bottom edge cut away at a shallow angle, as shown at 124, to provide clearance forthe struts 116.

Looking now at FIGS. 5 and 6, each of the upper, folding struts 118 consists of an upper portion 126 and a lower portion 128, which are pivoted together at 130 at approximately the mid-point of the strut. The upper end of the upper portion 126 is pivoted on the pivot pin 110, with a washer between itself and the inboard face of the depending leg of the support 18, while the lower end of the lower portion 128 is pivoted on the pivot pin 122, with a washer between itself and the inboard face of the web of the strut 116; thus, when it is straight, the strut 118 forms a diagonal of the quadrilateral having the pivot pins 110, 112, 120 and 122 at its corners, and thereby braces the supporting structure 12.

Figure 15:
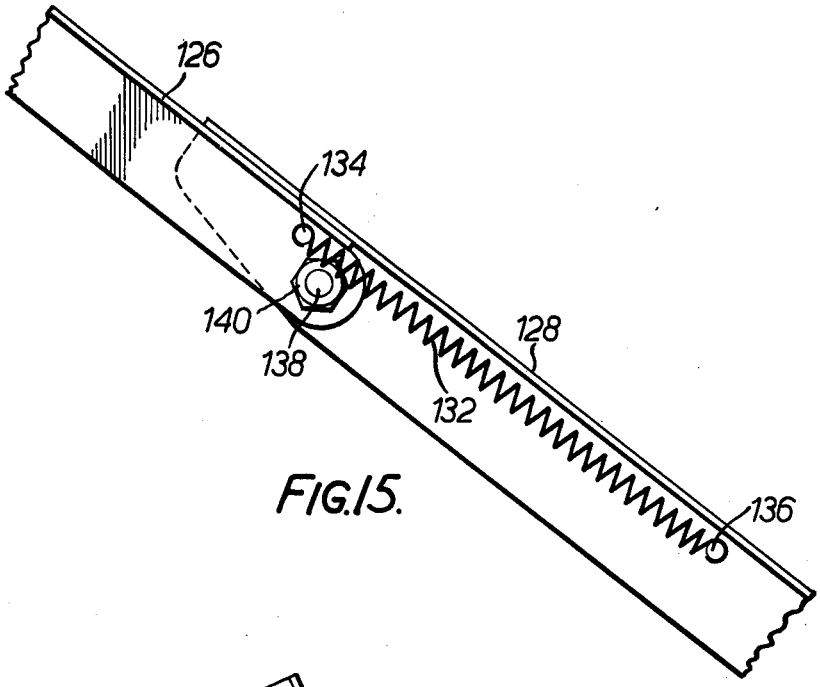
FIG. 15 is an enlarged view of one of the two folding struts that connect the two frames.
Figure 16:
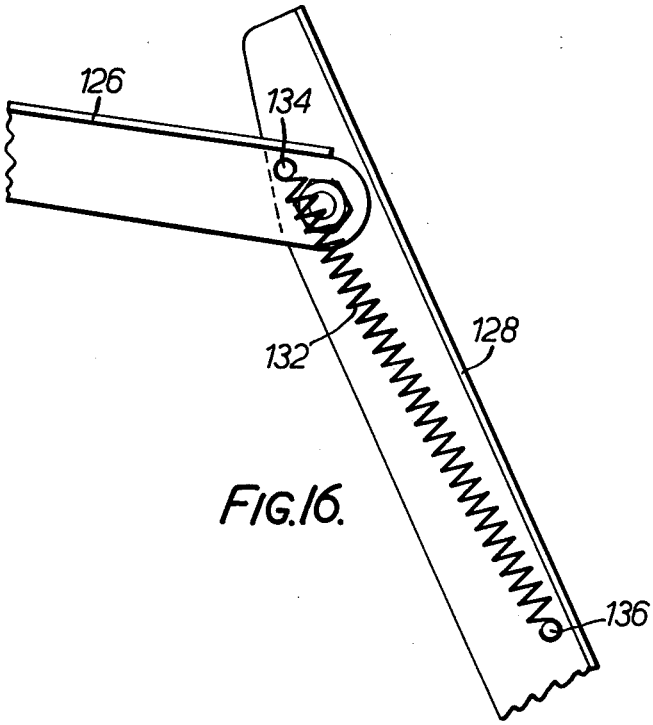
FIG. 16 is a view, similar to FIG. 15, but taken with the workbench partly collapsed.

As shown clearly in FIGS. 15 and 16, each portion of the struts 118 consists of a sheet steel pressing of L-shaped cross-section, arranged with the longer leg of the L poining vertically downwards and the shorter let of the L pointing horizontally inboard, towards the opposite end of the bench. The lower portion 128 of the strut lies outboard of the upper portion where they overlap in the region of the pivotal connection 130. The horizontal leg of the upper portion 126 terminates at its lower end alongside the pivotal connection 130, while its vertical leg continues only a short distance past the pivotal connection 130. However, both legs of the lower portion 128 extend past the pivotal connection 130 by about 1 ¼ inches; as can be seen from FIG. 14, this means that the horizontal leg of the lower portion 128 contacts the upper surface of the horizontal leg of the upper portion 126 when the strut 118 is in its straight position, so that the portions of the strut can pivot relative to one another about the pivotal connection 130 in the downwards direction only, or, to put it another way, the pivotal connection 130 can move only upwardly with respect to the two portions of the strut 118 when it folds. The pivotal connection 130 is slightly below the line joining the pivot pins 110 and 122 when the strut 118 is in its straight position, so that any tendency of the strut to fold as a result of compressive loading acts in the direction in which folding is prevented by the contact between the horizontal legs of the two portions of the strut.

The struts 118 are folded upwards, with the two portions of each strut swinging downwards relative to one another about the pivots 130, when it is desired to collapse the workbench for storage. FIG. 4 shows the workbench in course of being collapsed in this manner. The lengths of the two portions of each strut are so selected that, in the collapsed position, they lie within the outline of the elongate support 18 and the rear frame 24, as seen in side elevation as can clearly be seen in FIG. 3.

To help to lock the folding struts 118 into their straight position when the bench is erected, and to maintain them in this position, each strut has an over-center spring arrangement shown clearly in FIGS. 15 and 16 adjacent the pivotal connection 130. This arrangement includes a helical tension spring 132, which is connected at its ends to pins 134 and 136 welded to the inner vertical surfaces of the upper 126 and lower 128 portions of the strut 118. As can be seen from FIG. 15, in the straight position of the strut, the line of action of the spring 132 lies above the axis of the pivotal connection 130, and so the spring force, like any compressive forces on the strut, tends to lock the strut in its straight position. FIG. 16 shows how, if the bench is collapsed, the folding of the strut 118 results, after a certain amount of folding, in the line of action of the spring 132 lying below the axis of the pivotal connection 130, so that the spring 132 now tends to move the strut 118 to its fully folded position and holds the bench collapsed.

The pivotal connections 130 are of different construction from the pivot pins such as 110. Each of the connections 130 consists of a hexagon headed bolt 138, which is positioned with its head on the outboard side of the strut 118, and is fitted on the inboard side with a nut 140. The nut 140 is adjusted to allow the strut to fold easily, but without excessive play in the connection 130, and the end of the shank of the bolt 138 is then peened over to lock the nut 140 in position. A washer is placed between the two portions of the strut.

Both the head of the bolt 138 and the nut 140 are relatively thin, that is to say, about 3/32 inch. This allows the spring 132 to pass across the axis of the connection 130 as the strut 118 folds, and also allows the connections 130 to lie beside the rear leg 102 when the bench is collapsed, as illustrated in FIG. 3.

The rigid strut 116 lies on the inboard side of the legs 100 and 102, while the folding strut 118 lies on the inboard side of the rigid strut 116 and of the elongate support 18. This means that the only parts of the collapsible supporting structure 12 which are outboard of the elongate supports 18 are the legs 100 and 102. As can be seen from FIG. 7, the legs lie entirely forward and rearward of the vertical projection of the clamping gap between the vise beams 14 and 16. Thus, if it is desired to clamp a long workpiece like a door in a vertical position at one end of the vise beams 14 and 16, with the lower end of the workpiece extending down to ground level, the extent to which it can be inserted into the gap between the vise beams is not limited by the legs 100 and 102, but by the supports 18 and the struts 116 and 118. The supports 18 are therefore somewhat spaced laterally from the ends of the vise beams but, because the legs are outboard of the supports 18, the lateral spacing of the pads 108 is almost equal to the length of the vise beams 14 and 16, so that the bench has good stability.

Most of the inboard-pointing legs of the struts 116 and 118 terminate beside the appropriate pivot pin 110, 120 or 122, but the upper leg of the channel-section rigid strut 116 terminates about 1 inch short of the pivot pin 122 at its upper end. This is to allow the folding strut 118 to lie flat against the inboard side of the rigid strut 116, without being obstructed by the legs of the rigid strut.

Each of the step bars 104 consists essentially of a sheet steel pressing, which over the middle part of its length has an asymmetrical channel cross-section, as can be seen in FIG. 6. The limbs of the channel extend obliquely downwards at the same angle as the legs 100 or 102 to which the step bar is attached, with the inboard limb of the channel being much shallower than the outboard limb. The top surface of the step bar 104 extends horizontally, providing a surface on which the user of the bench can rest a foot to steady the bench, or step on bodily if wishing to use the bench top at sawhorse height relative to himself while the extension legs 32 are extended.

Figure 17:
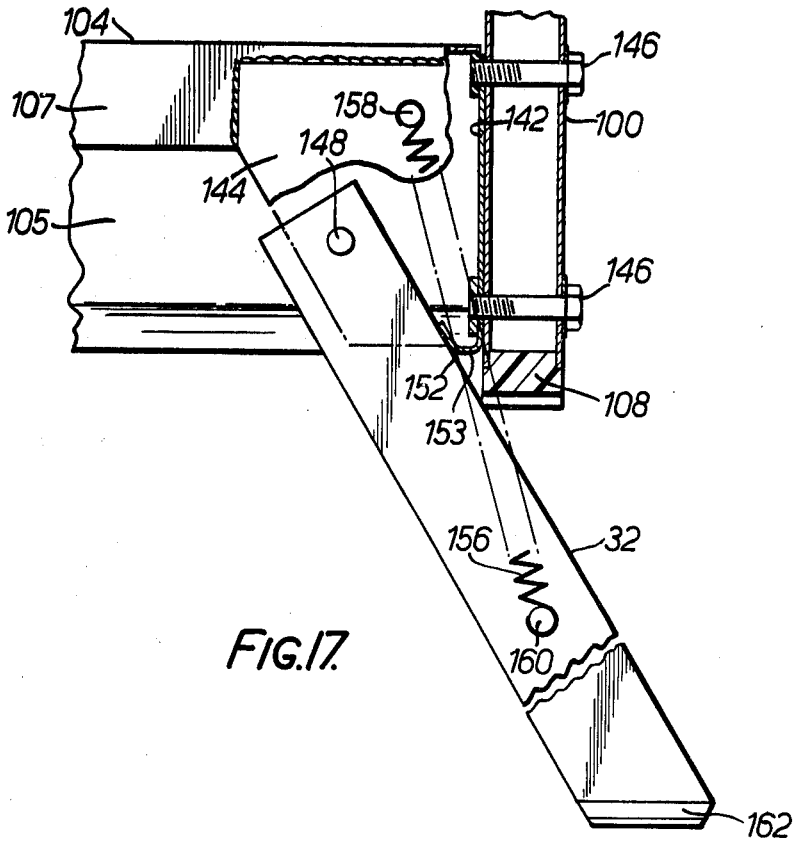
FIG. 17, is an enlarged view, partly in section, looking along the arrow XVII in FIG. 6, and showing one lower corner only of the workbench.

As shown in FIG. 17, a lengthways continuation of the longer, outwardly facing limb 105 of the channel section is folded around at each end of the step bar 104 to provide an end portion 142 which closes the end of the channel, and an inboard portion 144 which overlaps the inboard limb 107 of the channel, and in effect provides a downward extension of the inboard limb 107 of the channel to the same depth as the outboard limb 105, over the two end parts of the length of the step bar 104. The inboard folded portion 144 is welded to the inboard limb of the channel along its top and inboard edges.

The step bar 104 is secured between the legs of the front or rear frame 22 or 24 by two bolts 146 at each end, which pass through holes in the legs and in the end portion 142 of the step bar and are threaded into nuts which are welded or otherwise attached to the inside surface of the end portion 142.

Each of the extension legs 32 consists basically of a length of rectangular steel tubing. The upper end (with the extension leg 32 in its extended position) is received between the inboard folded portion 144 and the outboard limbs 105 of the step bar 104, with the wider sides of the rectangular section facing these portions of the step bar. A pivot pin 148 passes through these portions of the step bar and through the leg 32, so that the leg 32 can swing between its retracted position of FIG. 18 in which it extends approximately horizontally, within the cross-section of the step bar 104, and its extended position of FIG. 17. To ensure that the leg 32 does not rub against parts of the step bar 104 as it is swung about the pivot 18, a washer 150 is positioned on each side of the leg 32, between the leg and the adjacent part of the step bar.

In addition to the folded portions 142 and 144, the step bar 104 has at each end a further folded-in portion 152, best shown in FIG. 17, which extends from the bottom edge of the end portion 142, and is welded along both front and rear edges to the rest of the step bar. The folded-in portions 152 extends first horizontally inboard at 153 from the end of the step bar, and then, except for the extreme outboard part of its width at 154, adjacent the outboard limb 105 of the channel section of the step bar, extends obliquely upwards at an angle at 157 to match the inclination of the extension leg 32 when in its extended position. The oblique part 157 of the folded-in portion 152 provides an abutment which limits outward pivoting of the extension leg 32, and, together with the pivot pin 148, resists the bending loads which act in the plane of the front or rear frame 22 or 24 when the extension legs are in use.

To provide an abutment to support the extension legs against bending forces acting perpendicularly to the plane of the frames, the extreme outboard part 154 of the width of the folded-in portion 152 does not extend obliquely to match the angle of the extension leg; instead, it extends horizontally along the lower edge of the limb 105 so that it lies along the side of the extension leg 32 which is adjacent the longer, outboard limb 105 of the step bar 104, when the leg is in its extended position. The position of the shear cut which separates this part of the folded-in portion 152 from the oblique portion 157 is so chosen that it coincides with the plane of the adjacent side of the extension leg. Thus, although the leg 32 does not rub against the step bar through most of its pivoting movement, it engages the part 154 over the final stage of its movement to its extended position, so that the bending moments which tend to bend the leg outwards from the plane of the frame 22 or 24 when the extender legs are in use are resisted not only by the pivot pin 148, but also by the part 154. This arrangement holds the deflection of the extension legs 32 to a minimum.

Each of the legs 32 is provided with an overcenter spring arrangement to hold the leg firmly in either its retracted or its extended position. This arrangement consists of a helical tension spring 156, which is attached at one end to a pin 158, welded to the inboard folded portion 144 of the step bar, and at the otherend to a pin 160 which is welded to the inboard side of the leg 32. With the leg in its extended position, the line of action of the spring 156 lies outboard of the axis of the pivot pin 148, so that the spring force biases the leg outwards against the oblique abutment 157. When the leg is rotated to its retracted position, the line of action of the spring will, after about 60° of rotation, move across to the other side of the pivot axis, so that the spring force now tends to keep the leg in its retracted position.

Figure 18:
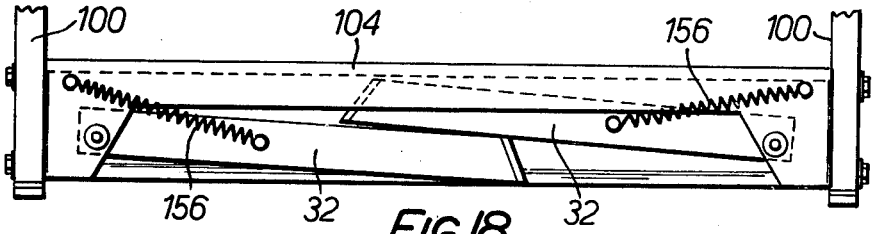
FIG. 18 is a view taken looking along the arrow XVIII in FIG. 5, showing only the lower part of one frame of the workbench.

As shown in FIG. 18, both the extension legs attached to one step bar can be accommodated within the cross-section of the step bar, even though their ends will overlap. Because the arrangement is symmetrical, it does not matter which leg is folded first. Although both legs, when folded, are hidden behind the deep outboard limb 105 of the channel section of the step bar, the lesser depth of the inboard limb 107 of the channel provides access to the extension legs for unfolding, and also provides clearance for the spring pins 160 when the extension legs are retracted.

Figure 19:
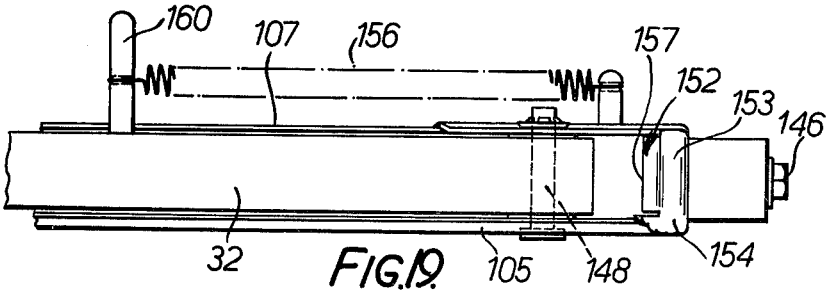
FIG. 19 is an enlarged view, taken looking along the arrow XIX in FIG. 5, and showing one lower corner only of the workbench.

To facilitate the manual movement of the extension legs 32 from their retracted positions to their extended positions, each of the spring pins 160 is extended about ¾ inch beyond the point at which the spring 156 is attached as shown in FIG. 19 to provide a convenient finger grip by which the legs 32 can be moved.

The ground-engaging end of each extension leg 32 is cut obliquely along the wider, front and rear surfaces of the leg, but at right angles to the length of the leg along the other two narrower surfaces of the leg, so that the cut end extends parallel to the ground surface when the extension legs are extended.

The obliquely cut end of each extension leg 32 is fitted with a plastic plug 162, which acts as a foot when the extension leg is in use. In this way, the legs 32 (before the attachment of the spring pins 160) are entirely symmetrical, so that there is no need to manufacture left-handed and right-handed legs separately.

The plastic plugs 162 are also symmetrical. As shown in FIG. 6 each plug has two plane surfaces 164 on its underside, which surfaces meet in an arris 166 lying in the plane of symmetry of the plug. As can be seen in FIG. 6, one of the surfaces 164 rests squarely on the ground when the extension legs 32 are extended.

Other components of the bench which are symmetrical include the rear spacer blocks 66, and the vise nuts 68.

Figure 20:
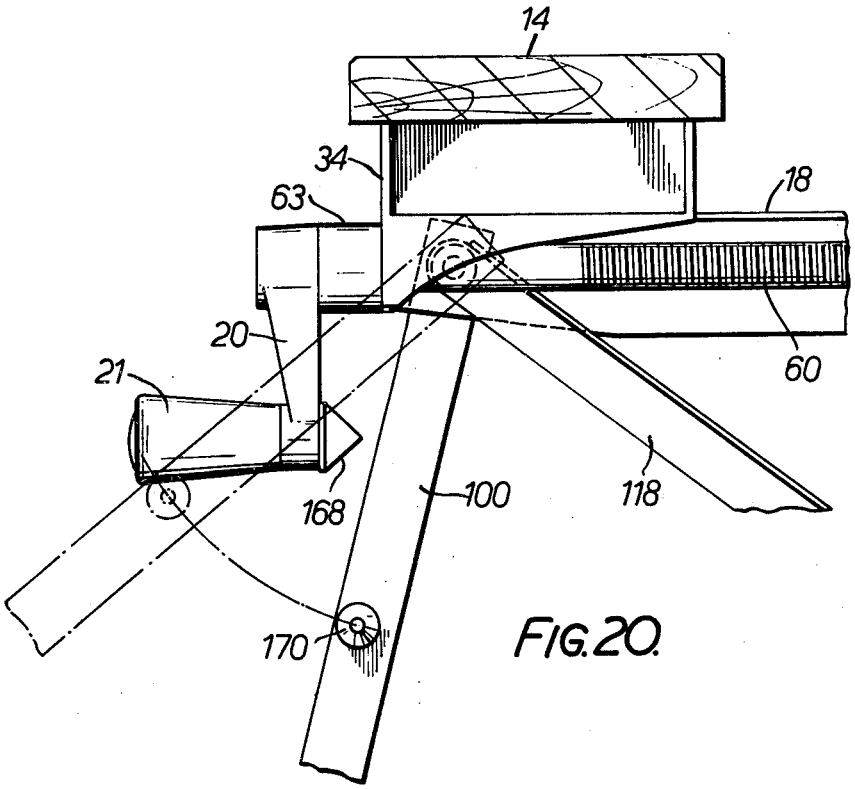
FIG. 20 is an enlarged sectional elevation of the upper front corner of the workbench and illustrating part of the folding action of the front frame.

It is possible that, when the workbench is folded from its errected position to its collapsed position, the front legs 100 will strike the crank handles 20, if these have been left in a downward and outward position. To prevent this contact from causing damage, each crank handle 20, as shown in FIG. 20 is fitted on its rear surface with a plastic cone 168 which points towards the rear of the bench. This cone is so arranged that, as the bench is collapsed, the cone is the first part of the handle 20 to be contacted by the leg 100 if the handle 20 has been left in an unsuitable position. Depending on whether the leg 100 strikes the cone 168 inboard or outboard of its apex, the handle 20 will be moved smoothly outboard as the bench is collapsed, so that it does not foul the leg 100.

If the handle 20 happens to be moved inboard by the engagement between the cone 168 and the leg 100, it may be left in a position in which it can foul the rigid strut 116 in the collapsed position. Indeed, it might be possible for the handle to be trapped between the leg 100 and the strut 116. For this reason, a conical plastic stud 170 (see FIG. 20) is snapped into a hole in the inboard lateral surface of each front leg 100, in such a position that it can engage the grip portion 21, of the crank handle 20, if this is in a position to be trapped between the strut 116 and the leg 100, and will move it further inboard, so that although contact will occur between the strut 116 and the handle 20, this contact will simply move the grip portion of the handle further inboard. FIG. 20 shows the path followed by the stud 170 when the bench is collapsed.

It should be noted that, when the bench is collapsed, it is not necessary to first move the extension legs 32 to their folded position. Thus, the bench can be stored either with its extension legs extended, if sufficient storage space is available, or with its extension legs retracted (as shown in FIG. 3) the bench is to occupy as little storage space as possible.

Certain advantages result from arranging the workbench to collapse by swinging its leg frames forwardly instead of rearwardly. For example, in the collapsed position, the crank handles 20 lie within the outline of the folded legs, and therefore do not increase the overall size of the collapsed workbench. Also, because they do not project outside the general outline of the collapsed bench, they are protected against damage in shipment that might otherwise occur. In addition, the workbench is convenient to carry in its collapsed condition, with the top surfaces of the vise beams 14 and 16 resting against the body of the person carrying the workbench, and when put down and erected from this position, the crank handles 20 are on the side of the erected workbench from which the bench was previously being carried, so that the user does not have to walk around the workbench. A similar workbench, having crank handles at the top of the worktop when the bench is collapsed, could be carried from the side opposite to that mentioned above, so that it would not be necessary to walk around the bench. However, erecting the bench would be somewhat inconvenient because the rear legs would rest on the ground while the bench was erected, and the front legs and top of the workbench would swing towards the user, forcing him to back away awkwardly and possibly bruising his legs. The preferred arrangement avoids this occurrence by removing any reason for carrying the workbench from this side.

Although the bench is very compact when in its folded position, it is possible to reduce still further the space which it occupies prior to sale to the user by offering it for sale in a partially disassembled or 'knocked-down' form. The bench can conveniently be sold as five major subassemblies, namely, a worktop sub-assembly, two leg and brace sub-assemblies, and two step bar sub-assemblies. The worktop sub-assembly comprises the two vise bars 14 and 16, the four spacer blocks 34 and 66, and two vise screws 60, and the two vise nuts 68. Each leg and brace sub-assembly comprises one of each of the following components: an elongate support 18, a front leg 100, a rear leg 102, a rigid strut 116, and a folding strut 118. Finally, each step bar sub-assembly comprises a step bar 104, fitted with two extension legs 32.

To assemble the 'knocked-down' workbench, the user has to place the blocks 34 and 66 on elongate supports 18, with the steps 56 and 80 of the spacer blocks engaging the inboard edges of the top horizontal flanges of the supports 18. The bolts 48 are then inserted through the bores 46 in the front vise beam, through the bore 42 in the front spacer block and then threaded and tightened in the underlying nut to hold the worktop and leg and brace sub-assemblies together. The moving vise beam 16 is connected by unscrewing the vise nut 68 off the screw 60 far enough to clear the bore 90, then passing the bolt 50 up through the aligned bores 90, 76 and 46, and threaded into the nut 48. The step bar sub-assemblies are then fitted between the legs 100 or 102, and secured by means of the bolts 146. The bench is then completely assembled.

Depending on the rigidity of the legs 102 and the elongate supports 18, it may be found desirable to insert a removable horizontal brace between the top rear corners of the supports 18, just below the horizontal flange thereof. This would prevent any possibility of the supports 18 from flexing outwardly. Such a brace could be a simple rod having a reduced portion at each end at which is threaded and presses through a hole in each support 18 of the same diameter as the reduced end portion of the rod, and is then secured by a nut at each end.

As an alternative to the use of the plastic studs 170 to move the grip portions of the crank handles 20 inboard when the bench is collapsed, the grip portions of the handles could simply be made of larger diameter, so that direct contact with the legs 100 moves the handles sufficiently far inboard that the subsequent engagement between the handles 20 and the struts 116 moves the handles 20 inboard rather than outboard.

A further possible alternative way of preventing the crank handles from being damaged by the legs 100 when the bench is collapsed is to construct the crank handles so that they can pivot relative to their vise screws to a folded position in which the grip portion of the handles points inwards, towards the vise beams 14 and 16, rather than outwards away from the vise beams. Thus, if the legs 100 should foul the crank handles, the handles would simply pivot towards their folded position. It is also possible for the handles to be folded manually before the bench is collapsed.

Detents may be provided to hold the handles in their working position, and possibly also in their folded position.

On occasion, it may be desired to clamp workpieces of circular cross-section such as pipes and dowels between the vise beams 14 and 16, with the axis of the workpiece generally parallel to the length of the vise beams. Such clamping is facilitated if V-grooves are provided to locate the workpiece. These V-grooves may, for example, be formed wholly in the spacer blocks 34 and 66, or alternatively partly in the spacer blocks and partly in the vise beams, in the form of a chamfer on each component. It is only necessary to provide a V-groove on one of the vise beams and spacer block assemblies to make it possible to clamp circular workpieces, securely, but V-grooves can be provided on both these assemblies without introducing any disadvantages.

Many other variations may be made in the design of the workbench without departing from its basic design. For example, the front and rear frames 22 and 24 may be designed to lie at different angles to the vertical when the bench is erected. The elongate supports 18 might be of some cross-section other than L-shaped; for example, they might be of channel cross-section. The pivots at the ends of the folding struts 118 need not coincide with the pivots connecting the frame 22 to the worktop 10 and connecting the rigid struts 116 to the frame 24; for example, it is possible for the top end of each folding strut 118 to be connected to a pivot positioned about halfway along the elongate support 18. The curved steps 80 which guide the moving vise beam 16 do not have to be parts of the same circle; so long as they are involutes of the same curve, the vise beam 16 will be adequately guided.

It should be noted that the worktop 10 need not be made in the form of a vise; a plain worktop could be fitted instead. This simplification is particularly worthwhile if the requirement is for a folding trestle rather than for a workbench; the advantages of the compact folding of the supporting structure 12 are still obtained, while the plain worktop reduces the cost of the product.

These and other modificiations and alterations may be made in the preferred embodiment specifically described and illustrated without departing from the sprit and scope of the appended claims which define the invention.

We claim:

1. A workbench, comprising:

a top structure, including front and rear elongate beams having upper surfaces lying in substantially the same plane to form a working surface; and a collapsible supporting structure which includes a first generally flat frame and a second generally flat frame, said frames being pivotally connected to the top structure for swinging movement in the front-to-rear direction about first and second pivot axes, respectively, between (a) a collapsed position in which the frames and the top structure lie close together, with the first frame lying on the same side of the second frame as does the top structure, and (b) an erected position in which the frames support the top structure above the ground, with the frames diverging downwardly from one another in the front-to-rear direction to provide a supporting area greater than the area of the working surface;

said supporting structure also including a front-to-rear extending link at each end thereof, each of said links being connected at its ends to said frames for pivoting relative thereto about third and fourth pivot axes, respectively; said third and fourth axes lying at a lower level than either of the first and second pivot axes when the supporting structure is in the erected position;

said third pivot axis lying at a level which is sufficiently below the level of the fourth pivot axis that the sum of the distances between the first and second pivot axes and between the first and third pivot axes is substantially equal to the sum of the distances between the second and fourth pivot axes and the third and fourth pivot axes, so that, in the collapsed position of the supporting structure, both the first and fourth pivot axes lie close to the plane passing through the second and third pivot axes;

at least said first frame including a pair of legs which are connected, at the ends thereof remote from the second pivot axis, by a horizontal bar;

said fourth pivot axis being located higher on said second frame than said horizontal bar and each link deviating from a straight line joining the third and fourth pivot axes, at least over the part of its length which lies adjacent the horizontal bar in the collapsed position of the supporting structure, the deviation being an upward deviation when seen in the erected position of the frames.

2. A workbench as claimed in claim 1 wherein the supporting structure also includes means for locking the frames in their erected position.

3. A workbench as claimed in claim 2, wherein the locking means includes at least one folding linkage having two parts connected by a pivot, the ends of each linkage being pivotally connected, respectively, to the second frame and to the top structure.

4. A workbench as claimed in claim 3, wherein the axes of the pivotal connections at the ends of each folding linkage coincide with the first and fourth pivot axes.

5. A workbench as claimed in claim 3 wherein, as the frames are moved from their collapsed to their erected position, each folding linkage moves through a position in which its three pivots are collinear, and shortly afterwards reaches a position in which further relative pivoting of the two parts of the linkage is prevented.

6. A workbench as claimed in claim 3, wherein each folding linkage is fitted with an overcentre action spring acting to hold the linkage in the erected position.

7. A workbench as claimed in claim 1, wherein the first and second frames lie at equal but opposite angles to the vertical when the frames are in the erected position.

8. A workbench as claimed in claim 1, wherein the working surface lies substantially horizontal when the frames are erected, and lies generally parallel to the frames when the frames are collapsed.

9. A combined workbench and sawhorse, comprising:

a top structure which includes a pair of laterally elongated beams having upper surfaces lying in substantially the same plane to form a working surface;

a pair of front main legs and a pair of rear main legs for supporting the top structure at sawhorse height, each pair of main legs being interconnected adjacent its lower end by a laterally extending strut;

a pair of front lower legs and a pair of rear lower legs pivoted respectively to the front and rear struts for movement in the plane of the struts between a retracted substantially horizontally position laterally inward of the respective pair of main legs, in which the main legs support the top structure at sawhorse height, and an extended position, in which the lower legs support the top structure at workbench height;

each lower leg in its extended position extending laterally outwardly and downwardly from the associated strut within the plane thereof to a point laterally outward of the respective main leg; and means carried by at least one of (1) the front and rear main legs and (2) the front and rear struts for defining thrust surfaces against which the front and rear lower legs, respectively, abut when in the extended position.

10. A workbench as claimed in claim 9 wherein the top structure further includes means for moving at least one of the beams relative to the other beam for clamping a workpiece therebetween.

11. A workbench as claimed in claim 9 wherein said front main legs extend downwardly and forwardly from said top structure such that the laterally extending strut interconnecting said front main legs is located at least in part forward of the front beam and forms a foot thrust member.

12. A workbench as claimed in claim 10 wherein the means for moving said one beam comprises a pair of independently operable clamping devices spaced along the length of the beams, whereby the gap between the beams may taper along the length of the beams, and the said one beam being restrained against rocking about axes parallel to its length in response to the reaction force exerted by a workpiece on the said one beam.

13. A workpiece as claimed in claim 12 wherein the top structure includes a pair of elongate supports which extend transversely to the length of the beams in the front-to-rear direction, one near each end of the beams and below the level of the beams, and on which the beams are mounted, the front and rear main legs being pivoted to the elongate supports.

14. A workbench as claimed in claim 13 wherein the beams project at their ends beyond the elongate supports for the beams.

15. A workbench as claimed in claim 14 wherein one leg of each pair of main legs is pivoted to one of the elongate supports on the side thereof which is remote from the other of the elongate supports, and, with the workbench erected and seen in plan view with the beams fully spaced apart in the front-to-rear direction, the two pairs of legs lie entirely forward and rearward, respectively, of the gap between the beams.

16. A workbench, comprising:

a top structure, including front and rear elongate beams having upper surfaces lying in substantially the same plane to form a working surface; and a collapsible supporting structure which includes a first generally flat frame and a second generally flat frame, said frames being pivotally connected to the top structure for swinging movement in the front-to-rear direction about first and second pivot axes, respectively, between (a) a collapsed position in which the frames and the top structure lie close together, with the first frame lying on the same side of the second frame as does the top structure, and (b) an erected position in which the frames support the top structure above the ground, with the frames diverging downwardly from one another in the front-to-rear direction to provide a supporting area greater than the area of the working surface;

said supporting structure also including a front-to-rear extending link at each end thereof, each of said links being connected at its ends to said frames for pivoting relative thereto about third and fourth pivot axes, respectively; said third and fourth axes lying at a lower level than either of the first and second pivot axes when the supporting structure is in the erected position;

said third pivot axis lying at a level which is sufficiently below the level of the fourth pivot axis that the sum of the distances between the first and second pivot axes and between the first and third pivot axes is substantially equal to the sum of the distances between the second and fourth pivot axes and the third and fourth pivot axes, so that, in the collapsed position of the supporting structure, both the first and fourth pivot axes lie close to the plane passing through the second and third pivot axes;

said supporting structure further including four pads on which the frames stand in the erected position thereof, and four retractable extensions, each of which has a ground contacting foot, two of the retractable extensions being mounted on one of the frames and the other two extensions being mounted on the other of the frames, said extensions being movable between an extended position in which the feet of the extensions can contact the ground, and a retracted position in which, whether the frames are collapsed or erected, each pair of extensions lies generally within the plane of the frame to which the pair of extensions is connected;

said top structure being supported on the extension feet at a first height above the ground when the frames are erected and the extensions are extended, and the top structure being supported on said pads at a second, lesser, height above the ground when the frames are erected and the extensions are in their retracted positions; said frames being collapsible and erectable whether the extensions are retracted or extended.

17. A workbench as claimed in claim 16 wherein said ground-engaging feet of the retractable extensions in the extended position thereof are spaced apart in the direction parallel to the axes of swinging of the frames by a distance greater than the spacing in the same direction of said pads.

18. A workbench as claimed in claim 17 wherein each retractable extension comprises a leg which is pivotable between the retracted position, in which it lies generally parallel to the axis of swinging of the frames, with its ground-engaging foot inboard of its other end, and the extended position, in which it extends obliquely outwards and downwards from the frame on which it is mounted.

19. A workbench as claimed in claim 18 wherein each retractable extension leg is provided with an overcenter action spring acting to hold it in whichever of its retracted and extended positions it has been placed.

20. A workbench, comprising:

a top structure, including a pair of elongate beams having upper surfaces lying in substantially the same plane to form a working surface; and a collapsible supporting structure which includes a first generally flat frame and a second generally flat frame, said frames being pivotally connected to the top structure for swinging movement about first and second pivot axes, respectively, between (a) a collapsed position in which the frames and the top structure lie close together, with the first frame lying on the same side of the second frame as does the top structure, and (b) an erected position in which the frames support the top structure above the ground, with the frames diverging from one another in the downward direction;

each of said frames comprising a pair of legs connected adjacent the ends thereof remote from the top structure by a horizontally extending channel having an opening facing downwards when said first and second frames are in the erected position;

said supporting structure including four pads, on which the frames stand in the erected position thereof, and four retractable extensions, each of which has a ground contacting foot, two of the retractable extensions being pivotally connected at the ends thereof remote from said feet to one of the channels and the other two extensions being pivotally connected at the ends thereof remote from said feet to the other of the channels, for pivotal movement between an extended position, in which the feet of the extensions contact the ground, and a retracted position, in which, whether the frames are collapsed or erected, each pair of extensions lies generally within the channel to which the pair of extensions is connected;

said top structure being supported on said feet at a first height above the ground when the frames are erected and the extensions are extended, and the top structure being supported on said pads at a second, lesser height above the ground when the frames are erected and the extensions are in their retracted position, said frames being collapsible and erectable whether the extensions are retracted or extended.

21. A support or workbench as claimed in claim 20 wherein the ground-engaging ends of the retractable extensions overlap when they are in their retracted position.

22. A workbench, comprising:

a top structure, including front and rear elongate beams having upper surfaces lying in substantially the same plane to form a working surface; and a collapsible supporting structure which includes a first generally flat frame and a second generally flat frame, each frame including a pair of legs connected adjacent the ends thereof remote from the top structure by a horizontal bar, said frames being pivotally connected to the top structure for swinging movement in the front-to-rear direction about first and second pivot axes, respectively, between (a) a collapsed position in which the frames and the top structure lie close together, with the first frame lying on the same side of the second frame as does the top structure, and (b) an erected position in which the frames support the top structure above the ground, with the frames diverging downwardly from one another in the front-to-rear direction to provide a supporting area greater than the area of the working surface;

said supporting structure also including a front-to-rear extending link at each end thereof, each of said links being connected at its ends to said frames for pivoting relative thereto about third and fourth pivot axes, respectively; said third and fourth axes lying at a lower level than either of the first and second pivot axes when the supporting structure is in the erected position;

said third pivot axis lying at a level which is sufficiently below the level of the fourth pivot axis that the sum of the distances between the first and second pivot axes and between the first and third pivot axes is substantially equal to the sum of the distances between the second and fourth pivot axes and the third and fourth pivot axes, so that, in the collapsed position of the supporting structure, both the first and fourth pivot axes lie close to the plane passing through the second and third pivot axes;

said supporting structure further including four pads, on which the frames stand in the erected position thereof, and four retractable extensions, each of which has a ground contacting foot, two of the retractable extensions being mounted on the horizontal bar of one of the frames and the other two extensions being mounted on the horizontal bar of the other of the frames, said extensions being movable between an extended position in which the feet of the extensions can contact the ground, and a retracted position in which, whether the frames are collapsed or erected, each pair of extensions lies generally within the frame to which the pair of extensions is connected;

said top structure being supported on said feet at a first height above the ground when the frames are erected and the extensions are extended, and the top structure being supported on said pads at a second, lesser height above the ground when the frames are erected and the extensions are in their retracted positions; said frames being collapsible and erectable whether the extensions are retracted or extended.

23. A support or workbench as claimed in claim 22 wherein each horizontal bar is readily detachable from the legs of its frame.

24. A workbench as claimed in claim 22, wherein said pads are connected, one each, to the end of each frame leg at the end thereof remote from the top structure.

25. A workbench, comprising:

a top structure including front and rear elongated beams having upper surfaces lying in substantially the same plane to form a working surface;

a collapsible supporting structure including first and second generally flat frames pivotally connected to the top structure for folding movement in the front-to-rear direction between (a) a collapsed position in which at least portions of the frames and the top structure lie close together with at least one of the frames lying generally parallel to the working surface, and (b) an erected position in which the frames diverge downwardly from one another in the front-to-rear direction and support the top structure above the ground with the working surface of the top structure lying substantially horizontal;

said frames each moving in the same rotary direction with respect to the top structure when folding from the erected to the collapsed position, with one frame leading the other, trailing frame during such rotation;

said supporting structure also including four retractable, footed extensions, two of which are mounted on one of the frames and the other on the other of the frames, said extensions being movable in the plane of the frame to which they are connected between an extended position in which the feet of the extensions extend downwardly and outwardly in said plane to contact the ground at points beyond the ends of said beams, and a retracted position in which, whether the frames are collapsed or erected, each pair of extensions lies generally within the plane and the general outline of the frame to which the extensions are connected to permit the frames and top structure to be collapsed closely together;

said top structure being supported at a first height above the ground when the frames are erected and the extensions are extended, and the top structure being supported at a second, lesser height above the ground when the frames are erected and the extensions are in their retracted positions, said frames being collapsible and erectable whether the extensions are retracted or extended.

26. A workbench as claimed in claim 25 in which each retractable extension comprises a leg which is pivotable between the retracted position, in which it lies generally parallel to the axes of swinging of the frames, with its ground-engaging foot inboard of its other end, and the extended position, in which it extends obliquely outwards and downwards from the frame on which it is mounted.

27. A workbench as claimed in claim 26 in which each retractable extension leg is provided with an over-center action spring acting to hold it in whichever of its retracted and extended positions it has been placed.

28. A workbench as claimed in claim 25, wherein each frame comprises a pair of legs connected, adjacent the ends thereof remote from the top structure, by a horizontal bar.

29. A workbench as claimed in claim 28 in which the retractable extensions are mounted on the horizontal bar of each frame.

30. A workbench as claimed in claim 29, wherein each horizontal bar is readily detachable from the legs of its frame.

31. A workbench as claimed in claim 28, wherein each leg of each frame has a ground-engaging pad at its end remote from the top structure.

32. A workbench as claimed in claim 25, wherein the frames, in the erected position, diverge in the downward direction and engage the ground on opposite sides of the plan projection of the worktop.

33. A workbench as claimed in claim 32 wherein the frames in the erected position lie at equal but opposite angles to the vertical.

34. A workbench as claimed in claim 25 wherein the top structure further includes means for moving at least one of the beams relative to the other beam for clamping a workpiece therebetween.

35. A workbench as claimed in claim 34, wherein the means for moving said at least one beam comprises a pair of independently operable clamping devices spaced along the length of the beams for moving said one beam angularly with respect to the other beam, whereby the gap between the beams may taper along the length of the beams; said one beam being restrained against rocking about axes parallel to its length in response to the reaction force exerted by a workpiece on the said one beam when the workpiece is clamped by the beams.

36. A workbench as claimed in claim 25 wherein at least the foremost of said first and second frames includes a foot thrust member extending in the direction of elongation of said beams, said foremost frame, in the erected position, diverging downwardly and forwardly from said top structure such that said foot thrust member is located at least in part forward of the front beam.

37. A combined workbench and sawhorse, comprising:

a top structure which includes a pair of elongate beams having upper surfaces lying in substantially the same plane to form a working surface;

four main supporting legs arranged to position the top structure at sawhorse height, the main legs including a pair of front legs and a pair of rear legs;

a horizontally extending strut interconnecting each pair of main legs adjacent the lower end thereof;

at least one of said struts providing a foot thrusting member positioned forwardly of the plan projection of the top structure;

said front pair of legs and the associated interconnecting strut constituting a generally flat front support, and said rear pair of legs and the associated interconnecting strut constituting a generally flat rear support, a pair of front lower legs pivoted to said front support and a pair of rear lower legs pivoted to said rear support, each of said lower legs having a retracted position and an extended position, in the latter of which said lower legs extend downward from said front and rear supports and collectively position the top structure at workbench height;

each lower leg, in its retracted position, extending substantially horizontally and in close juxtaposition to the strut of the support to which said leg is pivoted.

38. A workbench, comprising:

a top structure including a pair of elongate beams having upper surfaces lying in substantially the same plane to form a working surface; and a collapsible supporting structure including first and second generally flat frames pivotally connected to the top structure for folding movement between (a) a collapsed position in which at least portions of the frames and the top structure lie close together with at least one of the frames lying generally parallel to the working surface, and (b) an erected position in which the frames support the top structure above the ground with the working surface of the top structure lying substantially horizontal;

said frames each moving in the same rotary direction with respect to the top structure when folding from the erected to the collapsed position, with one frame leading the other, trailing frame during such rotation;

each frame comprising a pair of legs connected at the ends thereof remote from the top structure by a horizontally extending, downwardly opening channel;

said supporting structure also including four retractable extensions, having ground-engaging feet at the ends thereof, two of which are pivotally connected at the ends thereof remote from the ground-engaging feet to one of said channels and the other two of which are pivotally connected at the ends thereof remote from the ground-engaging feet to the other channel, for pivotal movement between an extended position, in which the feet of the extensions can contact the ground, and a retracted position, in which each pair of extensions lies substantially behind one of the limbs of the channel to which said pair of extensions is connected;

said top structure being supported at a first height above the ground when the frames are erected and the extensions are extended, and the top structure being supported at a second, lesser height above the ground when the frames are erected and the extensions are in their retracted positions, said frames being collapsible and erectable whether the extensions are retracted or extended.

39. A workbench as claimed in claim 38 wherein the ground-engaging feet of the retractable extension legs overlap in the retracted position.

40. A portable, dual-height workbench adapted to be carried by hand to a work site and there erected in a free-standing manner on a floor, comprising:

top structure, including front and rear, laterally elongated members having upper surfaces providing a working surface; and collapsible support means, including (1) a front leg frame and a rear leg frame, each comprising a substantially flat, generally U-shaped structure, (2) means connecting the upper ends of said front and rear leg frames to said top structure for pivotal movement in the front-to-rear direction between (a) an erected position, in which said front and rear leg frames extend generally downward from said top structure in front-to-rear, spaced-apart relation, and (b) a collapsed position, in which said front and rear leg frames extend generally parallel to said top structure, (3) a first set of floor-contacting feet mounted on said front and rear leg frames at the lower, closed ends thereof, (4) a pair of front leg extensions and a pair of rear leg extensions, (5) a second set of floor-contacting feet mounted on the lower ends of said front and rear leg extensions, and (6) means for mounting said front and rear leg extensions on said front and rear leg frames, respectively, adjacent the lower closed ends thereof for lateral pivotal movement of said extensions in the planes of the frames between (a) an extended position, in which each said leg extension extends downward from and laterally outward of the adjacent leg frame end, and (b) a retracted position, in which each said leg extension extends laterally inward of the adjacent leg frame end and lies above the level of said first set of floor contacting feet;

whereby said collapsible support means is adapted to support said top structure either at a first working height above the floor, when said front and rear leg frames are in the erected condition, said front and rear leg extensions are in the extended position, and said second set of floor-contacting feet engage the floor, or a second, lower working height above the floor, when said front and rear leg frames are in the erected condition, said front and rear leg extensions are in the retracted position, and said first set of floor-contacting feet engage the floor, and is further adapted to be folded to a storage condition in which substantially the entire collapsible support means is contained within the planes of the front and rear leg means regardless of whether said front and rear leg extensions are extended or retracted.

41. A workbench as claimed in claim 40, wherein at least said front leg frame includes at the closed lower end thereof a cross member which, in the erected position of said leg frames, is located at least in part forwardly of the front top member and provides a foot thrust surface on which a person may exert his weight during use of the workbench.

42. A collapsible workbench adapted to be carried by hand to a work site and there erected in a free-standing manner on a floor, comprising:

top structure, including front and rear, laterally elongated members having upper surfaces providing a working surface; and collapsible support means, including front and rear, generally flat leg frames connected at the upper ends thereof to said top structure for pivotal movement in the front-to-rear direction between (a) an erected position, in which said front and rear leg frames extend generally downward from said top structure, and (b) a collapsed position, in which said front and rear leg frames extend generally parallel to said top structure, each of said front and rear leg frames including a pair of laterally spaced-apart upper leg parts which are pivotally connected at the upper ends thereof to said bench top structure and which, in the erected position of said leg frames, diverge downwardly from one another in the front-to-rear direction, said upper leg parts lying entirely within the ends of said elongated top members, and a pair of laterally spaced-apart lower leg parts which are splayed downwardly and laterally relative to the respective upper leg parts to extend laterally beyond the lateral ends of said elongated top members.

43. A workbench as claimed in claim 42 wherein said front leg frame further includes a laterally extending cross member for providing, when said support structure is in the erected position, a generally horizontal foot thrust surface which is located at least in part forwardly of the front top member and on which a person may exert his weight during use of the workbench.

44. A workbench as claimed in claim 43 wherein said front and rear leg frames further comprise means mounting said lower leg parts to the respective front and rear leg frames for pivotal movement between said splayed position and a retracted position, in which said lower leg parts extend generally horizontally and lie above the level of the lower ends of said upper leg parts.

45. A portable workbench adapted to be carried by hand to a work site and there erected in a free-standing manner on a floor, comprising:

top structure, including (1) front and rear, laterally elongated members having upper surfaces providing a working surface and (2) means for moving at least one of said members relative to the other member to enable clamping of a workpiece therebetween; and collapsible support means, including (1) first and second leg frames connected at the upper ends thereof to said top structure for pivotal movement about first and second axes, respectively, in the front-to-rear direction between (a) an erected position, in which said first and second leg frames extend generally downward from said top structure in front-to-rear diverging relation, and (b) a collapsed position, in which said first and second leg frames extend generally parallel to said top structure, and (2) foldable linkage means interconnecting said first and second frames at each end thereof, each linkage means including (a) a lower rigid strut connected at one end to said first frame for pivotal movement about a third axis located adjacent the lower end of said first frame and at the other end to the second frame for pivotal movement about a fourth axis located intermediate in height to said third axis and said second axis, said lower strut in the erected position of the first and second frames extending generally forwardly and downwardly from said fourth axis to said third axis, and (b) an upper, collapsible strut pivoted at one end about said first axis and at the other end about said fourth axis, and further being foldable about a pivot point located intermediate the ends thereof between a rigid, extended position corresponding to the erected position of said first and second leg frames, in which said upper strut extends between said first and fourth axes generally diagonally across the area bounded by said first, second, third and fourth axes, and a collapsed position corresponding to the collapsed position of said first and second leg frames, in which said upper strut is folded about said pivot point and extends generally parallel to said top structure;

the foremost of said first and second leg frames including at the end thereof remote from the top structure a cross member extending in the direction of elongation of said top members, said cross member, in the erected position of said first and second frames, being located at least in part forwardly of the front top member and providing a foot thrust surface on which a person may exert his weight during use of the workbench.

* * * * *

UNITED STATES PATENT OFFICE

CERTIFICATE OF CORRECTION

Patent No. 4,157,174 Dated June 5, 1979

Inventor(s) Hickman et al.

It is certified that error appears in the above-identified patent and that said Letters Patent are hereby corrected as shown below:

Column 1, line 64, "comprises" should read --comprise--;
Column 4, line 40, "carried" should read --carries--;
Column 6, line 36, "for" should read --fore--;
Column 8, line 61, "againts" should read --against--;
Column 9, line 4, "agle" should read --angle--;
Column 9, line 21, "rigitity" should read --rigidity--;
Column 9, line 59, "asher" should read --washer--;
Column 11, line 12, after "is" delete "as";
Column 12, line 9, after "8°" insert --at--;
Column 12, line 10, "length" should read --lengths-- and "of" should read --for--;
Column 12, line 13, "that that" should read --that the--;
Column 12, line 16, "forthe" should read --for the--;
Column 12, line 33, "poining" should read --pointing-- and "let" should read --leg--;
Column 13, line 22, before "pivot" insert --other--;
Column 14, line 41, "18" should read --148--;
Column 14, line 49, "portions" should read --portion--;

UNITED STATES PATENT OFFICE

CERTIFICATE OF CORRECTION

Patent No. 4,157,174 Dated June 5, 1979

Inventor(s) Hickman et al.

It is certified that error appears in the above-identified patent and that said Letters Patent are hereby corrected as shown below:

Column 15, line 20, "otherend" should read --other end--;
Column 17, line 39, after "end" delete "at";
Column 19, line 38, "collinear" should read --co-linear--;
Column 19, line 63, "horizontally" should read --horizontal--.

Signed and Sealed this

*Twenty-first* Day of *September 1982*

[SEAL]

*Attest:*

GERALD J. MOSSINGHOFF

*Attesting Officer*

*Commissioner of Patents and Trademarks*